US007248817B2

(12) United States Patent
Kishi et al.

(10) Patent No.: US 7,248,817 B2
(45) Date of Patent: Jul. 24, 2007

(54) PROCESS CARTRIDGE AND IMAGE FORMING APPARATUS

(75) Inventors: Isao Kishi, Nagoya (JP); Satoru Ishikawa, Aichi-ken (JP); Tsutomu Suzuki, Nagoya (JP)

(73) Assignee: Brother Kogyo Kabushiki Kaisha, Nagoya-shi, Aichiken (JP)

( * ) Notice: Subject to any disclaimer, the term of this patent is extended or adjusted under 35 U.S.C. 154(b) by 141 days.

(21) Appl. No.: 11/189,036

(22) Filed: Jul. 26, 2005

(65) Prior Publication Data

US 2006/0045568 A1 Mar. 2, 2006

(30) Foreign Application Priority Data

Jul. 27, 2004 (JP) ..... P2004-219176

(51) Int. Cl.
*G03G 15/00* (2006.01)
*G03G 21/18* (2006.01)

(52) U.S. Cl. ..... 399/117; 399/90; 399/111

(58) Field of Classification Search ..... 399/111, 399/116, 117, 90, 159, 113
See application file for complete search history.

(56) References Cited

U.S. PATENT DOCUMENTS 5,966,566 A 10/1999 Odagawa et al.
6,072,968 A * 6/2000 Nomura et al. ..... 399/113
6,266,503 B1 7/2001 Murayama et al.
6,336,017 B1 * 1/2002 Miyamoto et al. ..... 399/116
6,832,061 B2 * 12/2004 Saito et al. ..... 399/111
7,020,410 B2 * 3/2006 Zogg et al. ..... 399/90
2005/0031374 A1 * 2/2005 Nagashima et al. ..... 399/117
2005/0220482 A1 * 10/2005 Ishii ..... 399/111

FOREIGN PATENT DOCUMENTS

JP 04-358192 A * 12/1992
JP 2001-175122 6/2001
JP 2002-40901 2/2002

* cited by examiner

*Primary Examiner*—Sophia S. Chen
(74) *Attorney, Agent, or Firm*—Banner & Witcoff, Ltd

(57) ABSTRACT

A process cartridge includes a photosensitive drum, a gear attachable to an end of the photosensitive drum in a longitudinal direction of the photosensitive drum, a shaft member capable of passing through an inside of the photosensitive drum and the gear so as to extend in the longitudinal direction of the photosensitive drum, and a frame having a pair of shaft supporting portions which supports both end portions of the shaft member at positions outside the photosensitive drum. One of the pair of shaft supporting portions functions as a gear-side supporting portion which is provided on a side where the gear is disposed. The gear includes a first insertion hole, into which the shaft member is inserted, and a projecting portion, which protrudes outward from a side, which is opposite to a side facing the end of the photosensitive drum, of the gear.

14 Claims, 26 Drawing Sheets

PROCESS CARTRIDGE AND IMAGE FORMING APPARATUS

CROSS REFERENCE TO RELATED APPLICATION

This application claims priority from Japanese Patent Application No. 2004-219176, filed on Jul. 27, 2004, whose subject matter which is incorporated herein in its entirety by reference.

BACKGROUND

Aspects of the present invention relate to a process cartridge and an image forming apparatus.

Japanese Laid-Open Patent Publication No. 2001-175122 discloses a process cartridge to be used for an image forming apparatus, such as a laser printer. In the process cartridge, a charging device, a developing device and a transfer roller are arranged around a photosensitive member, in order, with respect to a rotating direction of the photosensitive member. A surface of the photosensitive member is first uniformly charged by the charging device in accordance with the rotation of the photosensitive member, and then, is selectively exposed to a laser beam. As a result, electrical charge is partially removed from the surface of the photosensitive member and thus an electrostatic latent image is formed on the surface of the photosensitive member. Next, when the latent image formed on the surface of the photosensitive member faces the developing device, the latent image is developed into a toner image by supply of toner from the developing device. Then, the toner image held by the surface of the photosensitive member faces the transfer roller and is transferred onto a sheet when the sheet passes between the photosensitive member and the transfer roller.

SUMMARY

To attach the photosensitive member to a frame of the process cartridge to be used in the above-described image forming apparatus, a shaft member can be inserted into holes provided in the frame and holes provided at both ends of the photosensitive member. Before the photosensitive member and the frame are assembled, the frame and the photosensitive member are separate parts that are not connected with each other. Therefore, it is difficult to align the holes of the frame with the holes of the ends of the photosensitive member, and thus, the shaft member cannot be speedily inserted into the holes.

Aspects of the present invention provide a process cartridge to which a photosensitive drum can be easily mounted, and by extension, a process cartridge and an image forming apparatus having a structure that can be easily produced.

According to one aspect of the invention, a process cartridge includes a photosensitive drum, a gear that is attachable to an end of the photosensitive drum in a longitudinal direction of the photosensitive drum, a shaft member that is capable of passing through an inside of the photosensitive drum and the gear so as to extend in the longitudinal direction of the photosensitive drum, and a frame that has a pair of shaft supporting portions which supports both end portions of the shaft member at positions outside the photosensitive drum. One of the pair of shaft supporting portions functions as a gear-side supporting portion which is provided on a side where the gear is disposed. The gear includes a first insertion hole, into which the shaft member is inserted, and a projecting portion, which protrudes outward from a side, which is opposite to a side facing the end of the photosensitive drum, of the gear. The gear-side supporting portion of the pair of shaft supporting portions includes a second insertion hole, into which the shaft member is inserted, and a positioning member, which is used to position the projecting portion at a predetermined position and inwardly protrudes from a surface, which faces the photosensitive drum, of the gear-side supporting portion in the longitudinal direction of the photosensitive drum. The positioning member is arranged such that an opening of the first insertion hole and an opening of the second insertion hole overlap each other within a range in which the shaft member can be inserted thereto while the projecting portion is positioned at the predetermined position.

BRIEF DESCRIPTION OF THE DRAWINGS

An illustrative embodiment of the invention will be described in detail with reference to the following figures.

DETAILED DESCRIPTION

Figure 1:
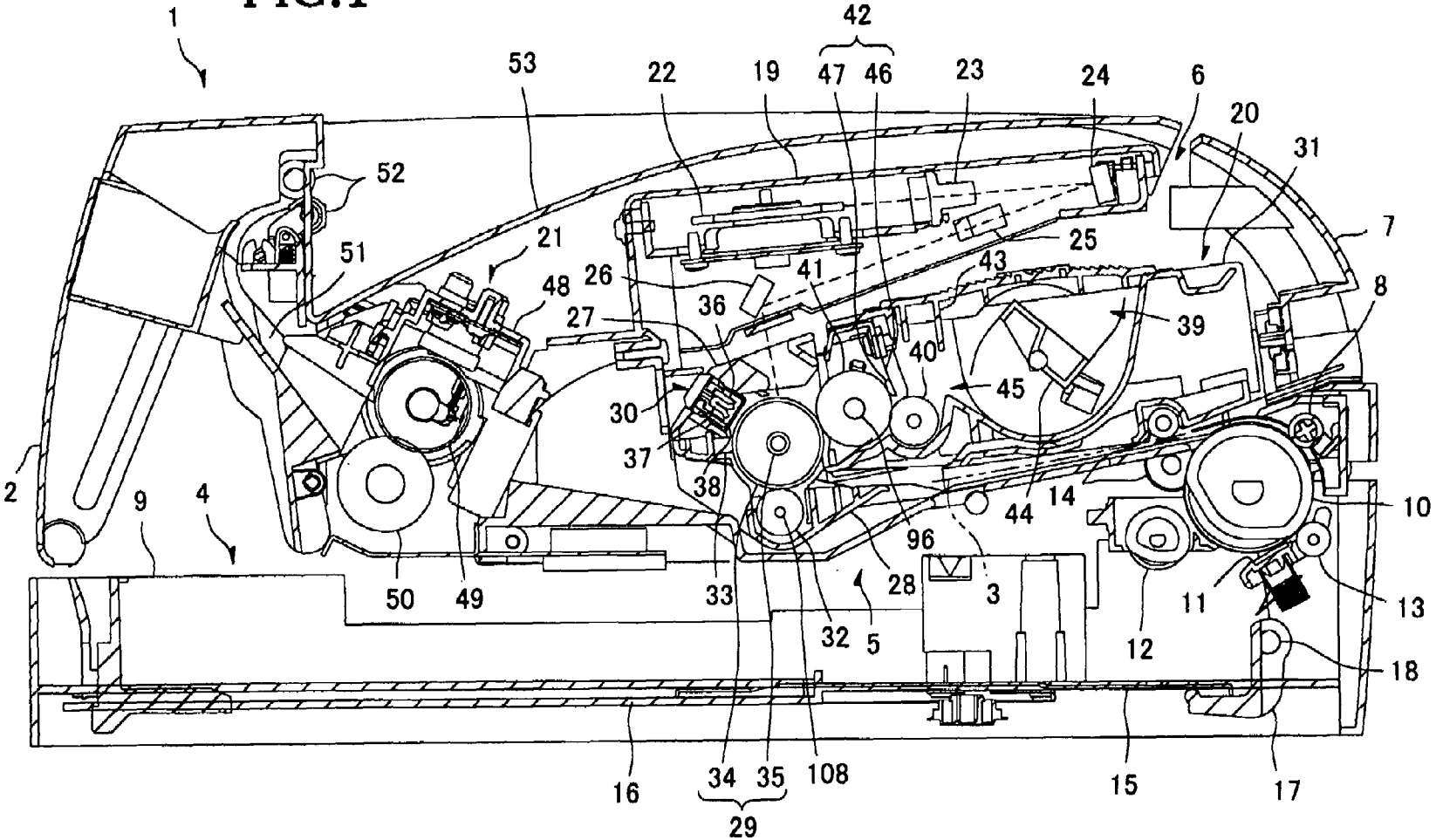
FIG. 1 is a sectional view of various parts of a laser printer as an image forming apparatus of an illustrative embodiment when a front cover is closed.

An illustrative embodiment of the invention will be described with reference to the accompanying drawings. As shown in FIG. 1, a laser printer 1 includes, in a main casing 2, a feeder unit 4 that supplies a sheet 3 as a transfer medium, and an image forming part 5 that forms an image on a sheet 3 supplied therein.

It is noted that various connections are set forth between elements in the following description. It is noted that these connections in general and, unless specified otherwise, may be direct or indirect and that this specification is not intended to be limiting in this respect.

Figure 2:
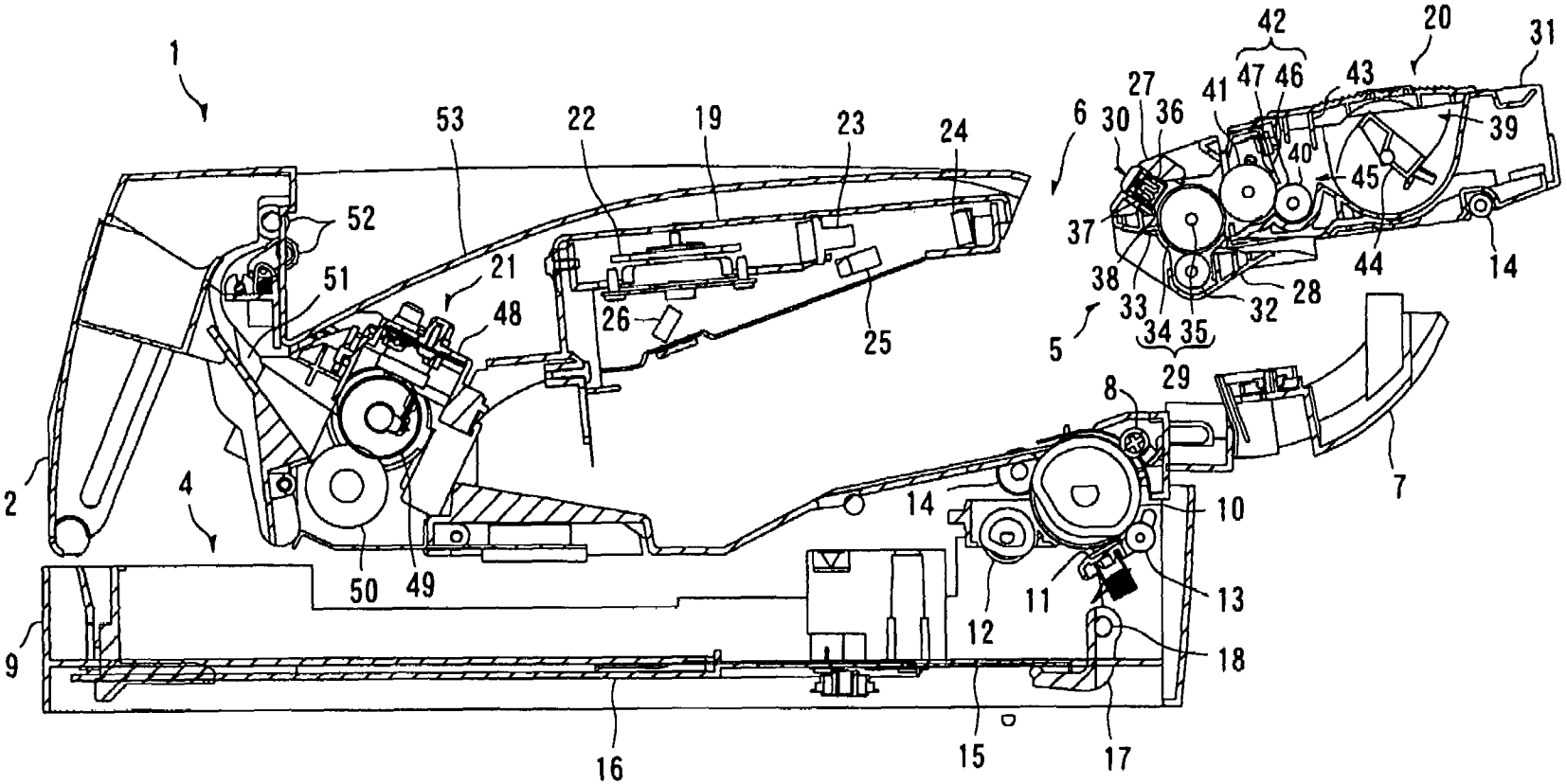
FIG. 2 is a sectional view of various parts of the laser printer shown in FIG. 1 when the front cover is opened in accordance with aspects of the present invention.

The main casing 2 is formed with an opening 6 through which a process cartridge 20 (described later) is inserted in or removed from the main casing 2 and a front cover 7 capable of opening and closing, thereby closing the opening 6. The front cover 7 is pivotally supported by a cover shaft (not shown), which is inserted into the front cover 7 at a lower end portion thereof. When the front cover 7 is closed around the cover shaft, the opening 6 is closed by the front cover 7 as shown in FIG. 1. When the front cover is opened (tilted) around the cover shaft, the opening 6 is opened by the front cover 7 as shown in FIG. 2, so that the process cartridge 20 can be inserted into or removed from the main casing 2 via the opening 6.

In the following description, a side on which the front cover 7 is provided will be referred to as the front side of the laser printer 1, and a side opposite to the front side will be referred to as the rear or back side.

The feeder unit 4 includes, at a bottom portion in the main casing 2, a sheet supply tray 9, a sheet supply roller 10, a separating pad 11, a pickup roller 12, a pinch roller 13, a paper dust removing roller 8, and register rollers 14. The sheet supply tray 9 is removably attachable to the bottom portion of the main casing 2. The sheet supply roller 10 and the separating pad 11 are provided at an upper portion of the front end portion of the sheet supply tray 9. The pickup roller 12 is provided at a rear side of the sheet supply roller 10. The pinch roller 13 is disposed facing the sheet supply roller 10 at a lower front side thereof. The paper dust removing roller 8 is disposed facing the sheet supply roller 10 at an upper front side thereof. The register rollers 14 are provided at an upper rear side of the sheet supply roller 10.

Inside the sheet supply tray 9, there is provided a sheet pressing plate 15 capable of holding sheets 3 in layers. The sheet pressing plate 15 is pivotally supported at its rear end. The sheet pressing plate 15 is vertically movable at its front end between a loading position and a conveying position. When in the loading position, the sheet pressing plate 15 is disposed such that its front end is positioned down and aligned with a bottom plate 16 of the sheet supply tray 9. When in the conveying position, the sheet pressing plate 15 is disposed such that its front end is inclined upward.

A lever 17 for raising the front end of the sheet pressing plate 15 is provided at a front end of the sheet supply tray 9. The lever 17 is formed in such a substantially L-shape in a sectional view that extends from the front side of the sheet pressing plate 15 to the underside thereof. The lever 17 is attached, at its upper end, to a lever shaft 18 provided at the front end portion of the sheet supply tray 9, and makes contact with the underside of the front end of the sheet pressing plate 15 at its rear end. When a clockwise (with respect to the drawing) rotation force is transmitted to the lever shaft 18, the lever 17 is rotated around the lever shaft 18 to raise the front end of the sheet pressing plate 15 by its rear end to the conveying position.

When the sheet pressing plate 15 is located at the conveying position, a sheet 3 on the sheet pressing plate 15 is pressed by the pickup roller 12, and is conveyed between the sheet supply roller 10 and the separating pad 11 upon rotation of the pickup roller 12.

On the other hand, when the sheet supply tray 9 is removed from the main casing 2, the sheet pressing plate 15 is moved down at its front end portion by its weight, and is located in the loading position. When the sheet pressing plate 15 is located in the loading position, it is capable of loading sheets 3 located thereon in layers.

An uppermost sheet 3 forwarded by the pickup roller 12 to the sheet supply roller 10 and the separating pad 11, is sandwiched between the sheet supply roller 10 and the separating pad 11 upon the rotation of the sheet supply roller 10, and is then reliably supplied, one by one, separately from the stack of the sheets 3. The supplied sheet 3 passes between the sheet supply roller 10 and the pinch roller 13. Then, paper dust adhering to the sheet 3 is removed by the paper dust removing roller 8, and the sheet 3 is further conveyed to the register rollers 14.

The register rollers 14 are paired. The register rollers 14 correct skewing of a sheet 3 and then feed the sheet 3 to a transfer position between a photosensitive member 29 (described later) and a transfer roller 32 where a toner image formed on a photosensitive member 29 is transferred onto the sheet 3.

The image forming part 5 includes a scanner unit 19, the process cartridge 20, and a fixing part 21.

The scanner unit 19 is disposed at an upper portion in the main casing 2. The scanner unit 19 includes a laser light source (not shown), a polygon mirror 22 that is driven and rotated, an fθ lens 23, a reflecting mirror 24, a lens 25, and a reflecting mirror 26. In the scanner unit 19, as shown in a chain line in FIG. 1, a laser beam emitted from the laser light source, based on print data, is deflected by the polygon mirror 22, passes through the fθ lens 23, is folded by the reflecting mirror 24, passes through the lens 25, is bent downward by the reflecting mirror 26, and then is directed to a surface of a drum body 34 (functioning as a photosensitive drum) of the photosensitive member 29 of the process cartridge 20.

Figure 6:
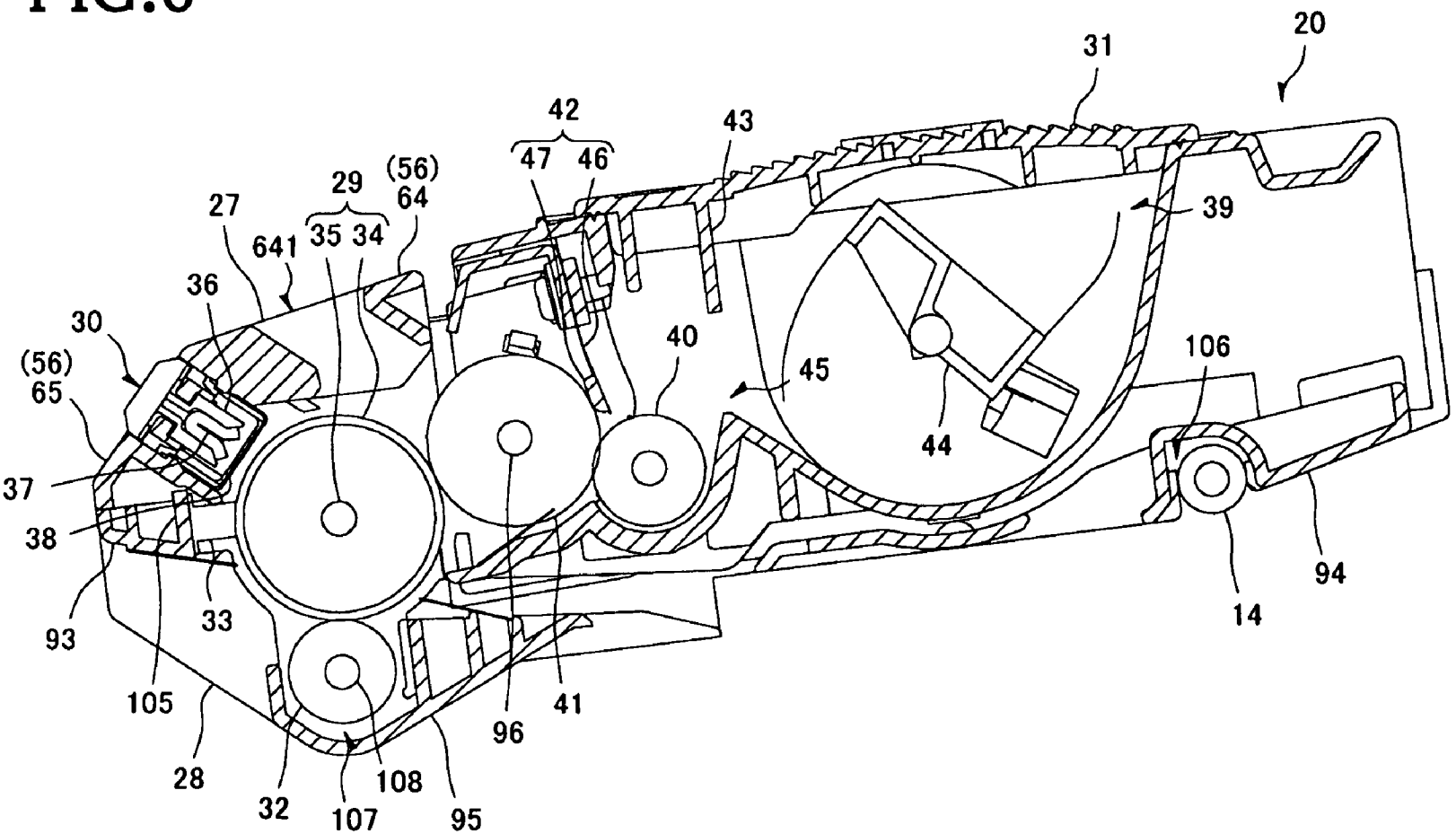
FIG. 6 is a sectional view taken along the line B-B of FIG. 3 in accordance with aspects of the present invention.
Figure 10:
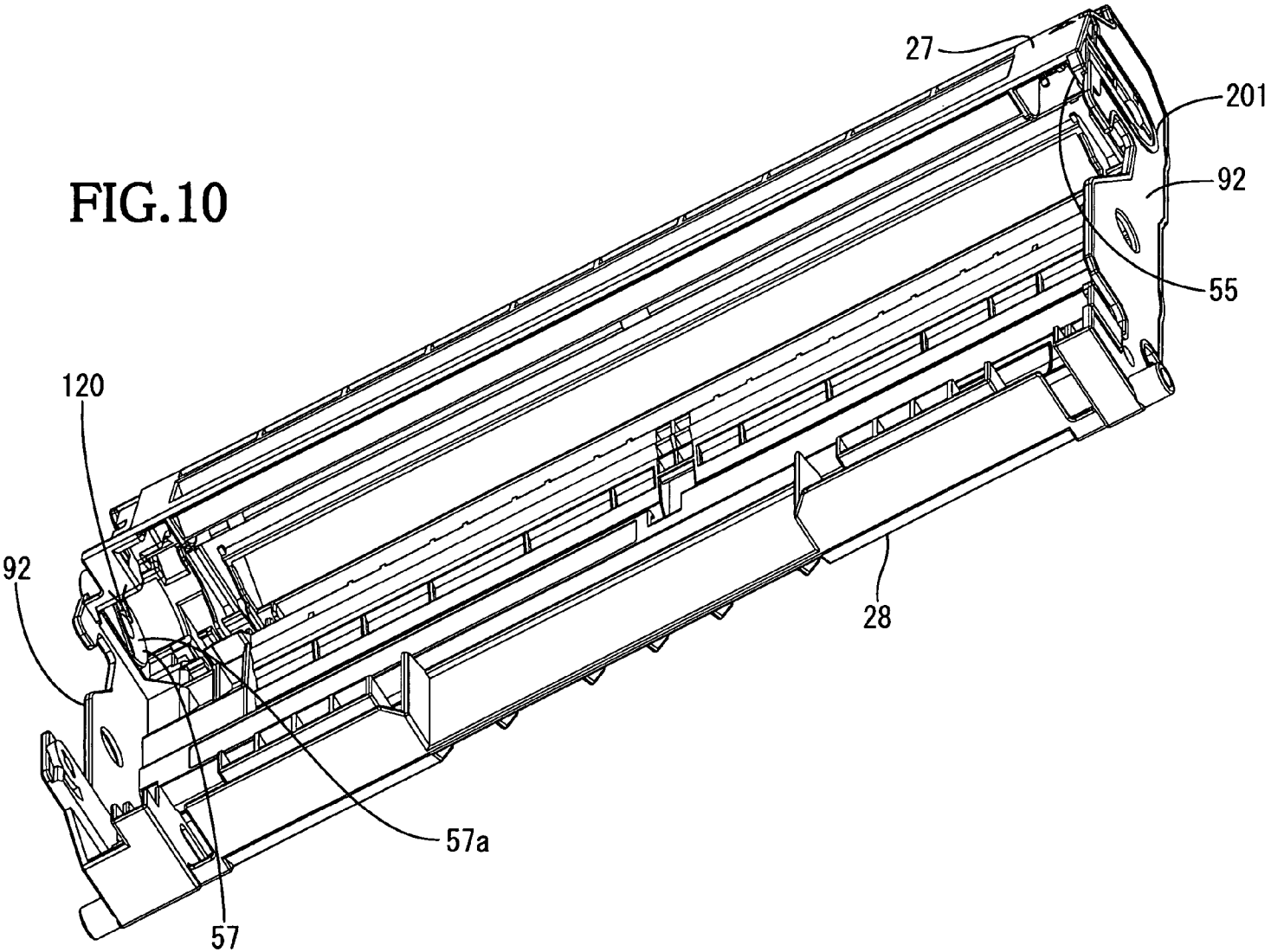
FIG. 10 is a perspective view showing the upper frame and the lower frame, which are joined to each other in accordance with aspects of the present invention.
Figure 11:
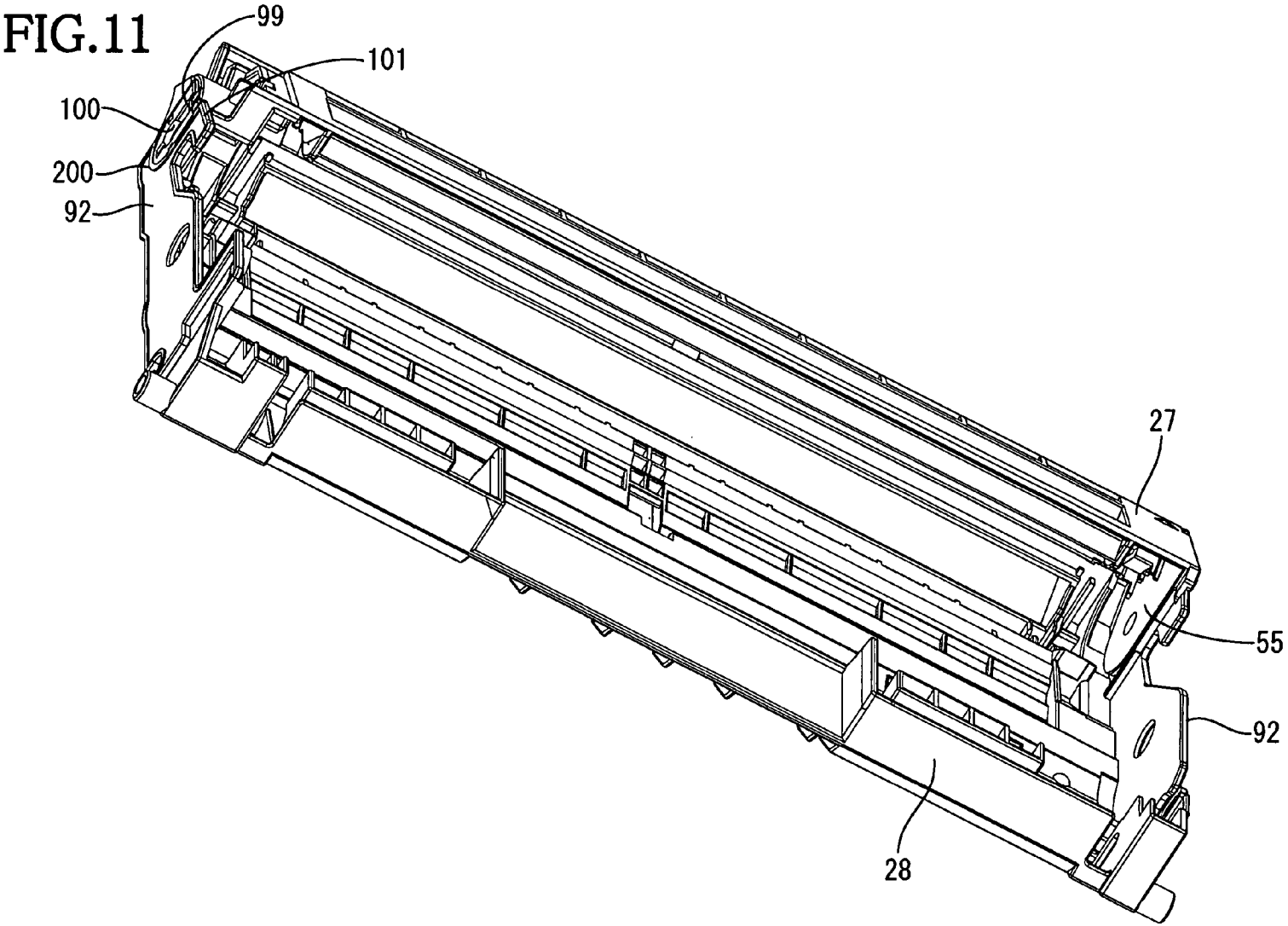
FIG. 11 is a perspective view showing the upper frame and the lower frame, which are joined to each other, when viewed from a different direction from FIG. 10 in accordance with aspects of the present invention.

The process cartridge 20 is detachably attachable to the main casing 2, below the scanner unit 19. The process cartridge 20 includes, as a housing, an upper frame 27 (functioning as a frame or a first frame portion) and a lower frame 28 (functioning as a frame or a second frame portion), as shown in FIGS. 10 and 11. The process cartridge 20 includes, in the housing, the photosensitive member 29, a scorotron charger 30 (functioning as a charging device), a developing cartridge 31, a transfer roller 32 (functioning as a transfer device), and a cleaning brush 33, as shown in FIG. 6.

The photosensitive member 29 is provided with the drum body 34 having a cylindrical shape, and a metallic drum shaft 35 (functioning as a shaft member). The drum body 34 is formed such that its outermost layer is a positively charged photosensitive layer made of, for example, polycarbonate. The drum shaft 35 is provided at a center axis of the drum body 34 and extends in a longitudinal direction of the drum body 34. The drum shaft 35 is supported by the upper frame 27, and the drum body 34 is rotatably supported by the drum shaft 35. With this structure, the photosensitive member 29 is provided such as to rotate about the drum shaft 35 in the upper frame 27.

The scorotron charger 30 is supported in the upper frame 27, and disposed facing the photosensitive member 29 at a specified distance so as not to contact the photosensitive member 29. The scorotron charger 30 is located at a diagonally-upper-rear position with respect to the photosensitive member 29. The scorotron charger 30 includes a discharge wire 37 and a grid 38. The discharge wire 37 is extended in an axial direction of the photosensitive member 29 so as to face the photosensitive member 29 at a specified distance provided therebetween. The grid 38 is provided between the discharge wire 37 and the photosensitive member 29 to control a discharge amount from the discharge wire 37 to the photosensitive member 29. The scorotron charger 30 applies a bias voltage to the grid 38 as well as a high voltage to the discharge wire 37, so that a corona discharge is generated from the discharge wire 37, and the surface of the photosensitive member 29 is uniformly positively charged.

The scorotron charger 30 is also provided with a cleaning member 36 for cleaning the discharge wire 37. The cleaning member 36 is provided so as to pinch the discharge wire 37 therebetween.

The developing cartridge 31 has a box shape and a rear open structure. The developing cartridge 31 is detachably attachable to the lower frame 28. In the developing cartridge 31, a toner chamber 39, a toner supply roller 40, a developing roller 41, and a layer-thickness regulating blade 42 are provided.

The toner chamber 39 is formed as an internal space at the front side of the developing cartridge 31 and partitioned by a partition plate 43. The toner chamber 39 contains, for example, positively charged nonmagnetic single-component toner, as a developing agent. The toner used in this illustrative embodiment is, for example, a polymerized toner obtained through copolymerization of styrene-based monomers, such as styrene, and acryl-based monomers, such as acrylic acid, alkyl (C1-C4) acrylate, and alkyl (C1-C4) methacrylate, using a known polymerization method, such as suspension polymerization. The particle shape of such a polymerized toner is substantially spherical, and thus the polymerized toner has excellent flowability and contributes to high-quality image formation.

A coloring agent, such as carbon black, and wax are added to the polymerized toner. An external additive, such as silica, is also added to the polymerized toner to improve flowability. The average particle size of the polymerized toner is approximately 6-10 μm.

An agitator 44 is provided in the toner chamber 39. Toner in the toner chamber 39 is agitated by the agitator 44, and is discharged from an opening 45, which communicates front and rear portions of the internal space of the developing cartridge 31 under the partition plate 43, toward the toner supply roller 40.

The toner supply roller 40 is disposed at the rear side of the opening 45 and rotatably supported by the developing cartridge 31. The toner supply roller 40 includes a metal roller shaft covered with a roller portion made of a conductive foam material. The toner supply roller 40 is driven and rotated by input of the power supplied from the motor (not shown).

Figure 3:
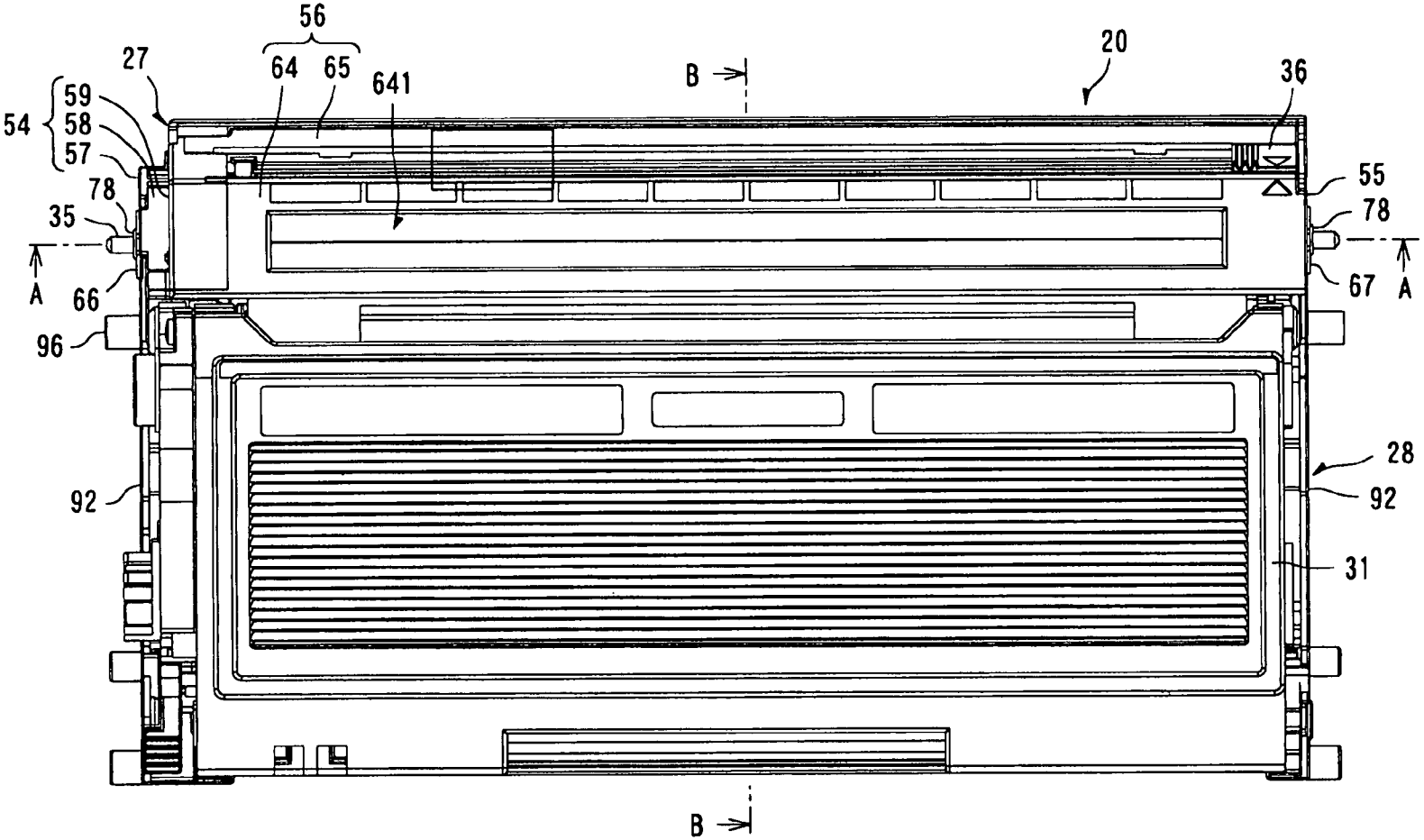
FIG. 3 is a plan view of a process cartridge shown in FIG. 1 in accordance with aspects of the present invention.
Figure 4:
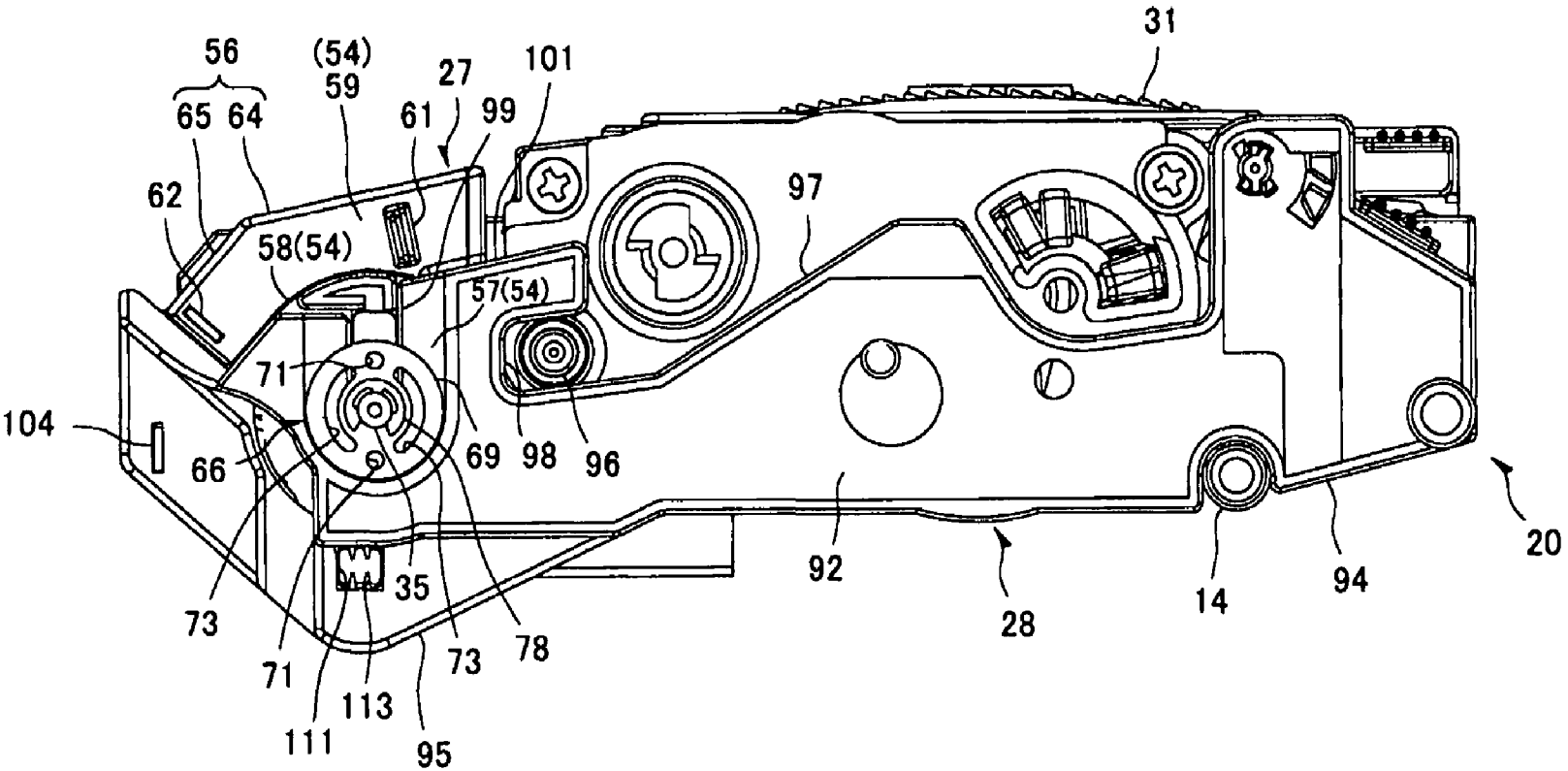
FIG. 4 is a side view of the process cartridge shown in FIG. 1 in accordance with aspects of the present invention.

The developing roller 41 is rotatably supported by the developing cartridge 31 so as to face the toner supply roller 40 behind the supply roller 40, in such a manner as to press into contact with the supply roller 40. The developing roller 41 contacts the photosensitive member 29 when the developing cartridge 31 is mounted in the lower frame 28. The developing roller 41 includes a metallic roller shaft 96 covered with a roller portion made of conductive rubber material. Each end of the roller shaft 96 protrudes outward from each side of the developing cartridge 31 in a width direction orthogonal to the front-rear direction (FIGS. 3 and 4). The roller portion of the developing roller 41 is made of a conductive urethane or silicone rubber, which includes carbon particles, with a coat layer made of urethane or silicone rubber, which includes fluorine. During developing, a developing bias is applied to the developing roller 41. The developing roller 41 is rotated in the same direction as the supply roller 40 by input of the power from the motor (not shown).

The layer-thickness regulating blade 42 includes a blade body 46 made of a metal plate spring member and a pressing portion 47 having a generally semicircular shape in cross section, provided at a free end of the blade body 46, and made of insulative silicone rubber. The layer-thickness regulating blade 42 is supported by the developing cartridge 31 in an upper portion of the developing roller 41, and is pressed against the developing roller 41 by elastic force of the blade body 46.

The toner discharged from the opening 45 is supplied to the developing roller 41 through the rotation of the toner supply roller 40, while being positively and frictionally charged between the toner supply roller 40 and the developing roller 41. The toner supplied onto the developing roller 41 then goes in between the pressing portion 47 of the layer-thickness regulating blade 42 and the developing roller 41. Along with the rotation of the developing roller 41, the toner is uniformly regulated to a specified thickness as a thin layer and carried on the developing roller 41.

The transfer roller 32 is rotatably supported by the lower frame 28. With the upper frame 27 and the lower frame 28 assembled, the transfer roller 32 is disposed so as to face and contact the photosensitive member 29 vertically and form a nip between the transfer roller 32 and the photosensitive member 29. The transfer roller 32 includes a metallic roller shaft 108 covered with a roller portion made of a conductive rubber material. During image transfer, a transfer bias is applied to the transfer roller 32. The transfer roller 32 is rotated in an opposite direction to the photosensitive member 29 by input of the power from the motor (not shown).

The cleaning brush 33 is attached to the lower frame 28 and is disposed, with the upper frame 27 and the lower frame 28 assembled, so as to contact the photosensitive member 29 from the rear.

Along with the rotation of the photosensitive member 29, the surface of the photosensitive member 29 is uniformly positively charged by the scorotron charger 30. Then, a laser beam emitted from the scanner unit 19 is scanned at high speed on the surface of the photosensitive member 29, thereby forming an electrostatic latent image corresponding to an image to be formed on the sheet 3 thereon.

With the rotation of the developing roller 41, toner carried on the developing roller 41 and positively charged makes contact with the photosensitive member 29, and is supplied to the electrostatic latent image formed on the surface of the photosensitive member 29. The toner is supplied to an exposure portion of the uniformly positively charged surface of the photosensitive member 29, where the potential has become low due to exposure to the laser beam. As a result, the electrostatic latent image on the photosensitive member 29 becomes visible and a reversal phenomenon takes place. Thus, a toner image is formed on the photosensitive member 29.

The toner image carried on the photosensitive member 29 is transferred onto the sheet 3 by a transfer bias applied to the transfer roller 32 while the sheet 3, conveyed by the register rollers 14, passes through the transfer position between the photosensitive member 29 and the transfer roller 32, as shown in FIG. 1. The sheet 3 onto which the toner image has been transferred is conveyed to the fixing part 21.

Toner remaining on the photosensitive member 29 after image transfer is collected by the developing roller 41. In addition, paper dust of the sheet 3 adhered on the photosensitive member 29 after the image transfer is collected by the cleaning brush 33.

The fixing part 21 is provided at the rear of the process cartridge 20, and includes a heat roller 49 and a pressure roller 50 in a fixing frame 48.

The heat roller 49 includes a metal tube and a halogen lamp inside the metal tube for generating heat. A surface of the metal tube is coated with, for example, fluorine resin. The heat roller 49 is rotated by input of the power from the motor (not shown).

The pressure roller 50 is disposed in a face-to-face relationship with the heat roller 49 so as to press against the heat roller 49 from underneath. The pressure roller 50 includes a metallic roller shaft covered with a roller portion made of a rubber material. The pressure roller 50 follows the rotation of the heat roller 49.

At the fixing part 21, toner transferred onto the sheet 3 at the transfer position is fixed on the sheet 3 by heat while the sheet 3 passes between the heat roller 49 and the pressure roller 50. The sheet 3, where toner is fixed by heat, is conveyed to a sheet ejection path 51 that extends toward the top surface of the main casing 2 in the up and down direction. The sheet 3 conveyed to the sheet ejection path 51 is ejected by ejection rollers 52, disposed above the sheet ejection path 51, and is stacked on a sheet discharge tray 53.

Figure 5:
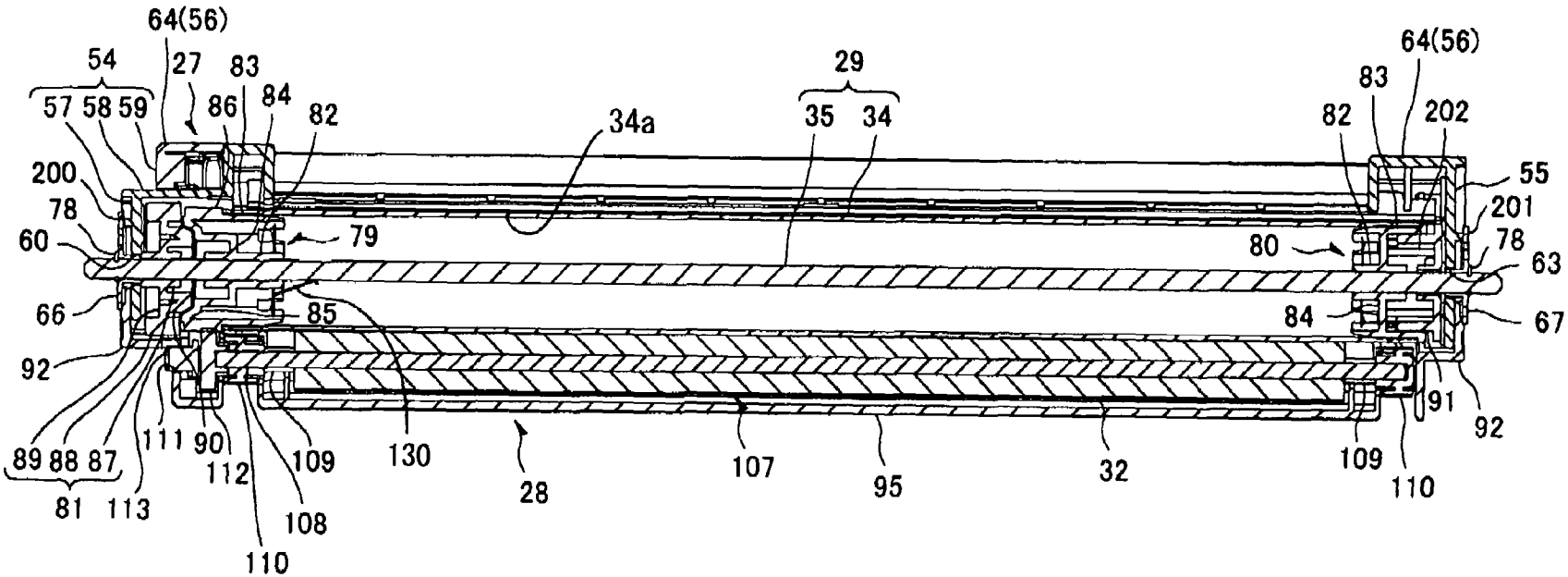
FIG. 5 is a sectional view taken along the line A-A of FIG. 3 in accordance with aspects of the present invention.

Referring to FIGS. 3 to 6, the process cartridge 20 will be described in detail. FIG. 3 is a plan view of the process cartridge 20; FIG. 4 is a side view of the process cartridge 20; FIG. 5 is a sectional view taken along the line A-A of FIG. 3; and FIG. 6 is a sectional view taken along the line B-B of FIG. 3.

The upper flame 27 includes a left sidewall 54, a right sidewall 55, and a top wall 56, which are integrally formed, as shown in FIG. 3, and is open at its front and bottom as shown in FIG. 6.

As shown in FIG. 5, the left sidewall 54 includes a left lower side plate portion 57, an overhang plate portion 58, and a left upper side plate portion 59. The left lower side plate portion 57 faces the drum body 34 at one side with respect to a width direction of the drum body 34, which is orthogonal to the front-rear direction (hereinafter the one side with respect to the width direction is referred to as the left side and the other side opposed to the one side is referred to as the right side). The overhang plate portion 58 extends from an upper end of the left lower side plate portion 57 toward the right and covers a drum gear 81 (functioning as a gear) from above. The left upper side plate portion 59 extends upward from the right end of the overhang plate portion 58 (FIGS. 3 and 4).

The left lower side plate portion 57 is formed with a second insertion hole 60 through which the drum shaft 35 passes and in which a bearing member 66 is engaged. In addition, the left lower side plate portion 57 is formed with a spacer portion 200 that protrudes outward to the left around the second insertion hole 60. The spacer portion 200 supports a flange portion 69 of the bearing member 66 with a slight distance away from the left side lower portion 57 in the right-left direction.

A wire electrode 61 and a grid electrode 62 are embedded in a front part and a rear part of the left upper side plate portion 59, respectively, as shown in FIG. 4. The wire electrode 61 is used for feeding the discharge wire 37 of the scorotron charger 30. The grid electrode 62 is used for feeding the grid 38 of the scorotron charger 30. The upper end of the left upper side plate portion 59 includes a horizontal portion that extends substantially horizontally with respect to the front-rear direction and an inclined portion that is inclined downward from the rear end of the horizontal portion.

As shown in FIG. 5, the right sidewall 55 is formed in substantially a flat plate shape and faces the drum body 34 from the right side. In association with the upper end of the left upper side plate portion 59, the upper end of the right sidewall 55 includes a horizontal portion that extends substantially horizontally with respect to the front-rear direction and faces the horizontal portion of the upper end of the left upper side plate portion 59, and an inclined portion that is inclined downward from the rear end of the horizontal portion and faces the inclined portion of the upper end of the left upper side plate portion 59. The right sidewall 55 is formed with a right-side support hole 63 through which the drum shaft 35 passes. A bearing member 67 is engaged in the right-side support hole 63. The right-side support hole 63 is provided at a position facing the second insertion hole 60 of the left lower side plate portion 57. In addition, the right sidewall 55 is formed with a spacer portion 201 that protrudes outward to the right around the right-side support hole 63. The spacer portion 201 supports a flange portion 69 of the bearing member 67 with a slight distance away from the right sidewall 55 in the left-right direction.

As shown in FIG. 3, the top wall 56 includes a top horizontal portion 64 and a top inclined portion 65.

The top horizontal portion 64 extends between the horizontal portion at the upper end of the left upper side plate portion 59 and the horizontal portion at the upper end of the right sidewall 55. The top horizontal portion 64 is disposed above the photosensitive member 29. In addition, the top horizontal portion 64 is formed with a laser emission window 641 through which a laser beam scanned at high speed from the scanner unit 19 enters. The laser emission window 641 is open in a rectangular shape in a plan view.

The top inclined portion 65 extends between an inclined portion at the upper end of the left upper side plate portion 59 and an inclined portion at the upper end of the right sidewall 55. The top inclined portion 65 is disposed at a specified distance from the top horizontal portion 64 with respect to the front-rear direction and at a diagonally-upper-rear position with respect to the photosensitive member 29.

The top inclined portion 65 is provided with the scorotron charger 30. In other words, the discharge wire 37 is extended between the left upper side plate portion 59 and the right sidewall 55, in the top inclined portion 65. The grid 38 is extended between the left upper side plate portion 59 and the right sidewall 55, in the top inclined portion 65. The cleaning member 36 is provided at the top inclined portion 65 so as to be movable in the left-right direction with the discharge wire 37 sandwiched therein. The discharge wire 37 can be cleaned by moving the cleaning member 36 in the left-right direction (FIG. 6).

The drum shaft 35 of the photosensitive member 29 is supported between the left lower side plate portion 57 and the right sidewall 55 via the bearing members 66, 67 disposed at the left and right sides, respectively.

Each of the bearing members 66, 67 is made of a resin material such as POM (polyacetal resin), ABS (acrylonitrile butadiene styrene resin), and PS (polystyrene resin). As shown in FIGS. 7A to 9C, each of the bearing members 66, 67 integrally includes a shaft insertion portion 68, the flange portion 69, and a fixing portion 70.

The shaft insertion portion 68 has an inside diameter substantially the same size as the outside diameter of the drum shaft 35, and is formed into a cylindrical shape so as to cover an outer peripheral surface of the drum shaft 35.

Figure 7C:
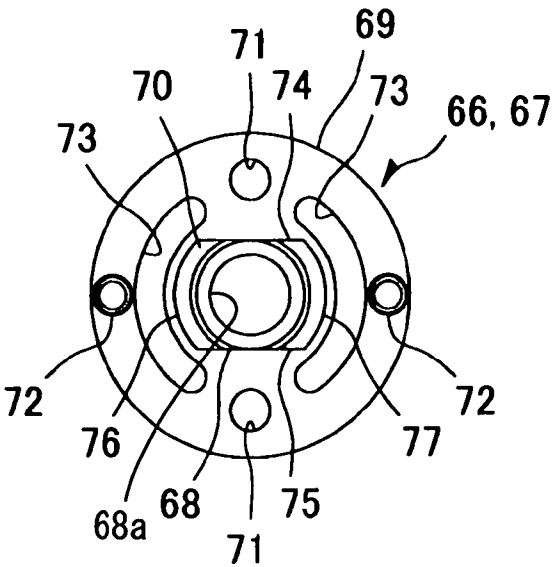
FIG. 7C is a rear elevation of the bearing receiving member shown in FIG. 4 in accordance with aspects of the present invention.
Figure 7B:
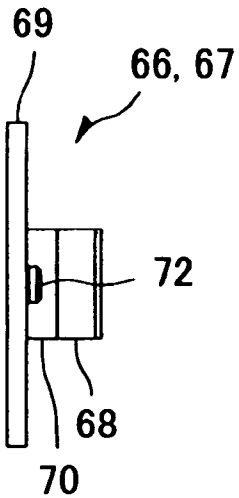
FIG. 7B is a side elevation of the bearing member shown in FIG. 4 in accordance with aspects of the present invention.
Figure 7A:
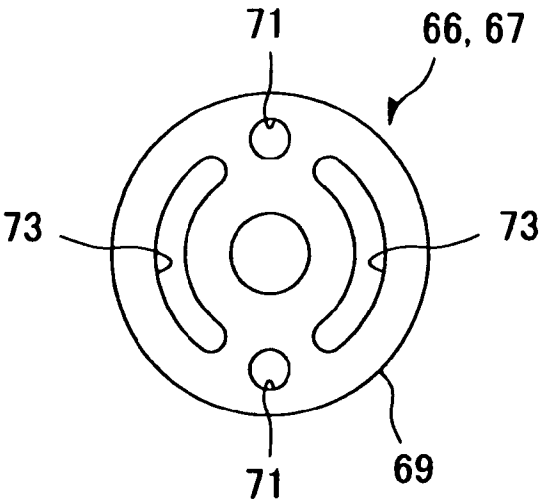
FIG. 7A is a front elevation of a bearing member shown in FIG. 4 in accordance with aspects of the present invention.

As shown in FIGS. 7A, 7B, and 7C, the flange portion 69 is formed in a circular plate jetting out from an end of the shaft insertion portion 68 with respect to its axial direction, in a direction orthogonal to the axial direction. The flange portion 69 is formed with two jig holes 71, which are provided symmetrically with respect to the shaft insertion portion 68. The flange portion 69 is also formed with two cylindrical engaging protrusions 72, which are located on a side where the shaft insertion portion 68 extends, symmetrically with respect to the shaft insertion portion 68. A direction where the two engaging protrusions 72 are opposed is orthogonal to a direction where the jig holes 71 are opposed. Further, the flange portion 69 is formed with arc-shaped long holes 73 located between the shaft insertion portion 68 and each of the engaging protrusions 72. The long holes 73 are centered on a central axial line of the shaft insertion portion 68. The long holes 73 allow the flange portion 69 to warp, so that the engaging protrusions 72 are moved along the axial direction of the shaft insertion portion 68.

The fixing portion 70 is formed on the same side of the flange portion 69 as the shaft insertion portion 68 extends therefrom so as to protrude around the shaft insertion portion 68 lower than the shaft insertion portion 68. As shown in FIG. 7C, the fixing portion 70 is formed so as to jut from the shaft insertion portion 68 toward the engaging protrusions 72. The fixing portion 70 includes a pair of flat side surfaces 74, 75 and a pair of curved side surfaces 76, 77. The flat side surfaces 74, 75 are located in a face-to-face relationship with each other at the same distance away as the outside diameter of the shaft insertion portion 68 in a direction where the jig holes 71 are opposed to each other. The curved side surfaces 76, 77 are located in a face-to-face relationship with each other at a distance away greater than the outside diameter of the shaft insertion portion 68 in a direction where the engaging protrusions 72 are opposed to each other (that is, in the direction orthogonal to the direction of the jig holes 71).

As shown in FIG. 5, the left bearing member 66 is attached to the left lower side plate portion 57 by inserting the shaft insertion portion 68 into the second insertion hole 60 from the left side of the left lower side plate portion 57. In this state, the flange portion 69 of the left bearing member 66 is in contact with the spacer portion 200, and is spaced a slight distance away from the left lower side plate portion 57. The right bearing member 67 is attached to the right sidewall 55 by inserting the shaft insertion portion 68 into the right-side support hole 63 from the right side of the right sidewall 55. In this state, the flange portion 69 of the bearing member 67 is in contact with the spacer portion 201, and is spaced a slight distance away from the right sidewall 55.

End portions of the drum shaft 35 are inserted into the shaft insertion portions 68 of the left and right bearing members 66, 67 respectively, and locking members 78 (FIG. 8) are fitted on the end portions of the drum shaft 35 from outside. Thereby, the drum shaft 35 is supported by the left sidewall 54 and the right sidewall 55 via the bearing members 66, 67.

Both the end portions of the drum shaft 35 protrude outward with respect to the left-right direction from the corresponding bearing members 66, 67. A ground (not shown) is connected to the end portion of the drum shaft 35 that protrudes from the left bearing member 66. The ground is provided in the main casing 2 to ground the drum shaft 35 when the process cartridge 20 is mounted in the main casing 2.

Between the bearing members 66, 67, the drum shaft 35 is inserted into flange members 79, 80 (FIGS. 5 and 9) and the drum gear 81 such that the flange members 79, 80 and the drum bear 81 can rotate relative to the drum shaft 35. The flange members 79, 80 are fitted on both the end portions of the drum shaft 35 in the axial direction of the drum shaft 35. The drum gear 81 is disposed on the left end portion of the drum shaft 35 in the axial direction of the drum shaft 35. The drum shaft 35 supports the drum body 34 via the flange members 79, 80 so as to rotate the drum body 34 relative to the drum shaft 35.

The flange members 79, 80 are made of an insulation resin material, and are attached to both the end portions of the drum body 34 in a manner so as to rotate integrally with the drum body 34. Each of the flange members 79, 80 integrally includes a flange bearing portion 82 where the drum shaft 35 is inserted, an insertion portion 83 that is to be inserted into the drum body 34, and a flange connection portion 84 that connects the flange bearing portion 82 and the insertion portion 83.

The flange bearing portion 82 has an inside diameter substantially the same size as an outside diameter of the drum shaft 35, and is formed into a cylindrical shape so as to cover an outer peripheral surface of the drum shaft 35.

The insertion portion 83 has an outside diameter substantially the same size as an inside diameter of the drum body 34, and is formed into a cylindrical shape so as to be inserted in contact with the inner peripheral surface of the drum body 34.

The flange connection portion 84 is formed in an annular plate shape so as to extend between the flange bearing portion 82 and the insertion portion 83 in a radial direction of the drum body 34.

The left flange member 79 is integrally formed with a flange-side connection portion 85 and an output gear 86. The flange-side connection portion 85 is used for connection with the drum gear 81 and the output gear 86 is used for engagement with a transfer gear 112.

The flange-side connection portion 85 is constructed so as to protrude leftward from a middle of the flange-side connection portion 85 at its outer edge with respect to the radial direction of the flange connection portion 84.

The output gear 86 is of substantially cylindrical shape that extends leftward continuously from the insertion portion 83. The output gear 86 includes a plurality of external teeth that protrude outward with respect to the radial direction to mesh with the transfer gear 112.

The drum gear 81 is provided on the left side of the left flange member 79, and integrally includes a gear bearing portion 87 where the drum shaft 35 is inserted, an input gear 88 that engages a driving transmission gear (not shown), and a gear connection portion 89 that connects the gear bearing portion 87 and the input gear 88.

The gear bearing portion 87 has an inside diameter substantially the same size as the outside diameter of the drum shaft 35, and is formed into a cylindrical shape so as to cover an outer peripheral surface of the drum shaft 35.

The input gear 88 is of substantially a cylindrical shape. The input gear 88 includes a plurality of external teeth that protrude outward with respect to the radial direction to mesh with the driving transmission gear (not shown).

The gear connection portion 89 is formed in an annular plate shape so as to extend between the gear bearing portion 87 and the input gear 88 in the radial direction of the gear connection portion 89.

In addition, the gear connection portion 89 is integrally formed with a gear-side connection portion 90 intended for connection to the flange-side connection portion 85 of the left flange member 79. The gear-side connection portion 90 is constructed so as to protrude rightward from a middle of the gear connection portion 89 with respect to its radial direction.

The drum gear 81 is bonded to the left flange member 79 by confronting the gear bearing portion 87 and the flange bearing portion 82 of the left flange member 79 in the axial direction and adhesively fixing the gear-side connection portion 90 and the flange-side connection portion 85 of the left flange member 79. The drum gear 81 is rotated integrally with the left flange member 79.

As an alternative, the drum gear 81 may be integrally formed with the left flange member 79.

The left flange member 79 and the drum gear 81 are attached to the left end portion of the drum body 34 in a manner so as to rotate integrally with the drum body 34 by press-fitting the insertion portion 83 of the drum gear 81 to the left end portion of the drum body 34 from a left-side opening of the drum body 34.

The right flange member 80 is attached to the right end portion of the drum body 34 in a manner so as to rotate integrally with the drum body 34 by inserting press-fitting the insertion portion 83 to the right end portion of the drum body 34 from a right-side opening of the drum body 34.

Accordingly, each of the flange members 79, 80 is attached to the corresponding one of both end portions of the drum body 34 to rotate integrally with the drum body 34, and is supported by the drum shaft 35 so that they are rotated relative to the drum shaft 35. Thus, the photosensitive member 29 is rotatably supported by the drum shaft 35 via the flange members 79, 80.

Figure 21:
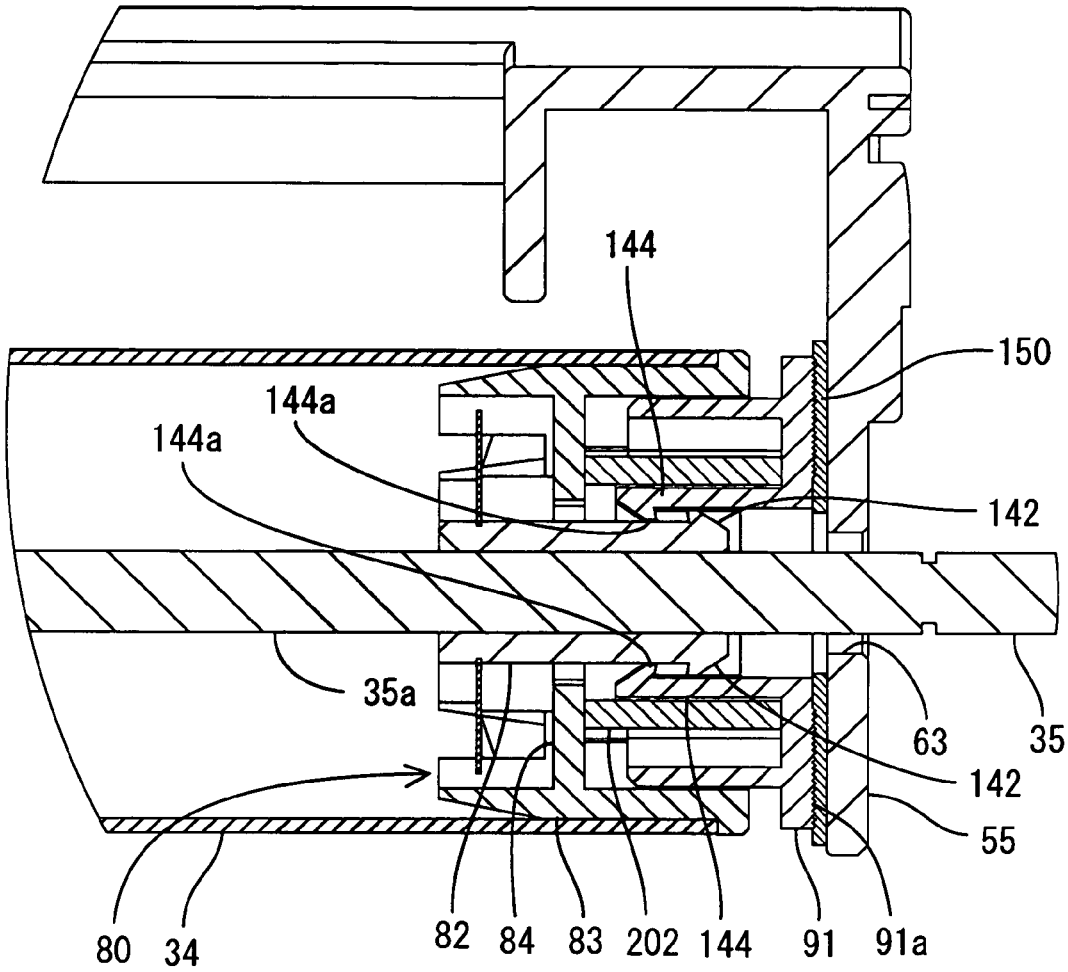
FIG. 21 is a sectional view showing a structure of a right end portion of the photosensitive member in accordance with aspects of the present invention.

The right sidewall 55 facing the right flange member 80 is provided with a spring receiving member 91 through which the drum shaft 35 passes and a spring 202 that is received by the spring receiving member 91, between the right sidewall 55 and the right flange member 80 (FIGS. 5 and 21).

The spring receiving member 91 is formed in a shape of an inverse C letter in cross section, and opens leftward. The spring receiving member 91 is supported at the inside of the right sidewall 55. The spring 202 is provided around the drum shaft 35, and urges the flange member 80 toward the left when held by the spring receiving member 91. In this manner, the drum gear 81 bonded to the left flange member 79 is brought into contact with the left lower side plate portion 57 of the left sidewall 54, so that the photosensitive member 29 is positioned with respect to its axial direction.

When a driving force is transmitted from a motor (not shown) provided in the main casing 2 to the driving transmission gear (not shown), the input gear 88 in mesh with the driving transmission gear is rotated and thus the photosensitive member 29 is rotated.

The lower frame 28 integrally includes a pair of sidewalls 92 (FIG. 5), a rear connection portion 93, a lower front connection portion 94, and a lower rear connection portion 95 (FIG. 6) that all connect bottom edge portions of the sidewalls 92. The lower frame 28 is shaped so as to open upward.

As shown in FIG. 5, the pair of sidewalls 92 are disposed opposite to each other to sandwich the upper frame 27 and the developing cartridge 31 (FIG. 4) therebetween. As shown in FIG. 4, each sidewall 92 includes a roller shaft guiding portion 97, a roller shaft receiving portion 98, a bearing member guiding portion 99, and a bearing member receiving portion 100. The roller shaft guiding portion 97 is used for guiding an end portion of a roller shaft 96 of the developing roller 41 when the developing cartridge 31 is attached to or removed from the lower frame 28. The roller shaft receiving portion 98 is provided at a rear end of the roller shaft guiding portion 97 to receive the end portion of the roller shaft 96 guided by the roller shaft guiding portion 97. At a rear of the roller shaft receiving portion 98, the bearing member guiding portion 99 forms a path for guiding the fixing portion 70 of the bearing member 66, 67 when the upper frame 27 is attached to or removed from the lower frame 28. The bearing member receiving portion 100 functions as a receiving portion and is provided at a bottom portion of the bearing member guiding portion 99 to receive the fixing portion 70 guided by the bearing member guiding portion 99.

Figure 8:
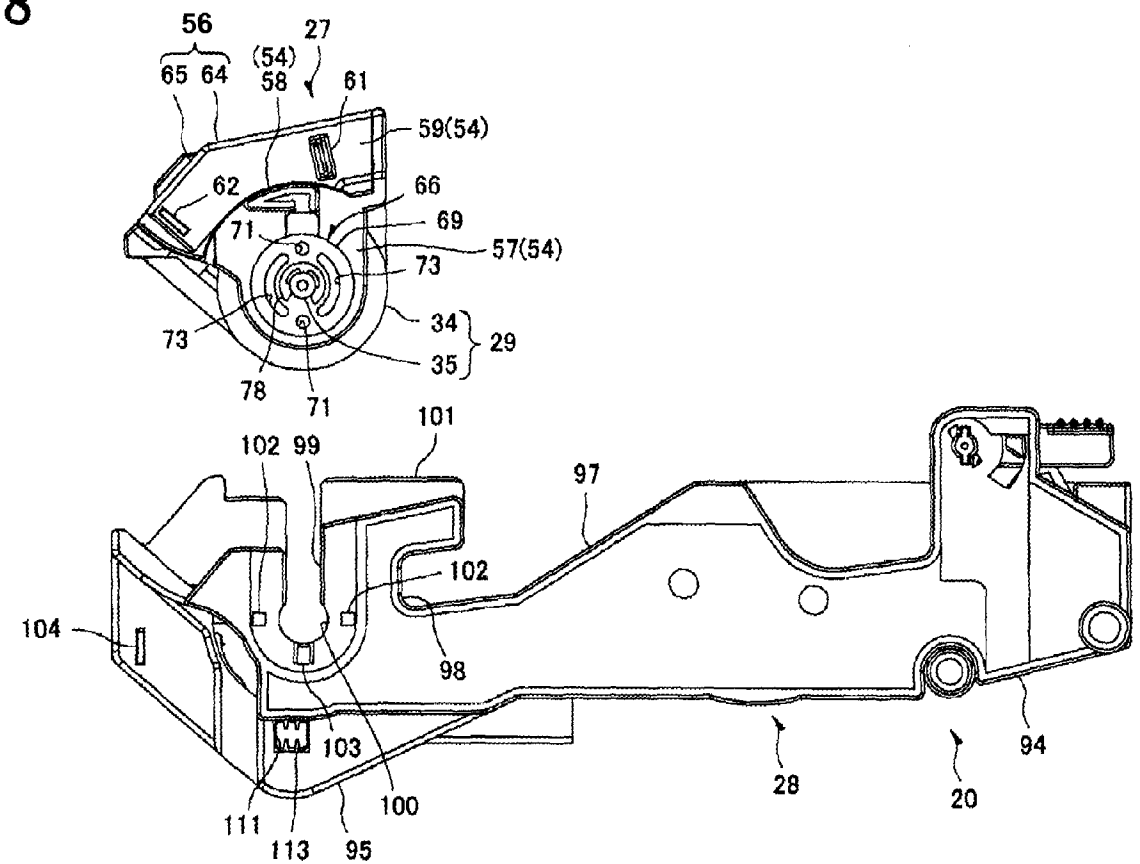
FIG. 8 is a side view showing an upper frame and a lower frame, which are shown in FIG. 4, separated from each other in accordance with aspects of the present invention.

As shown in FIGS. 4 and 8, the roller shaft guiding portion 97 is formed as an upper edge of the each sidewall 92 at substantially a center with respect to the front-rear direction. The roller shaft guiding portion 97 extends obliquely downward from the front to the rear, and then extends substantially horizontally.

In each sidewall 92, the roller shaft receiving portion 98 is continuous with the rear side of the shaft guiding portion 97 and is formed in a substantially rectangular shape so as to be recessed from a front end portion of a protrusion portion 101 that protrudes frontward at an upper portion of the roller shaft receiving portion 98.

A space further forward than the roller shaft receiving portion 98 is used for attaching the developing cartridge 31. Each end portion of the roller shaft 96, which protrudes from both sides of the developing cartridge 31, is guided by the roller shaft guiding portion 97, is moved toward the roller shaft receiving portion 98, and is received by the roller shaft receiving portion 98. Thus, the end portions of the developing cartridge 31 are supported by the pair of the sidewalls 92. In this manner, the developing cartridge 31 is mounted in this space.

When the developing cartridge 31 is mounted in the lower frame 28, both the end portions of the roller shaft 96 are exposed outward from the sidewalls 92 via the roller shaft receiving portions 98 (FIG. 3). When the process cartridge 20 is mounted in the main casing 2, an electrode for applying a developing bias is connected to the left end portion of the roller shaft 96.

The bearing member guiding portion 99 is a substantially U-shaped groove that vertically extends from the top end of the protrusion portion 101 of each sidewall 92 toward a lower place and opens at its top (FIG. 8). The bearing member guiding portion 99 is formed so that its width is substantially the same distance as an interval between the flat side surfaces 74, 75 of the fixing portion 70 of each bearing member 66, 67. With this formation, when the flat side surfaces 74, 75 are along a guide direction (vertical direction) of the bearing member guiding portion 99, the fixing portion 70 is allowed to enter the bearing member guiding portion 99. Alternatively, when the flat side surfaces 74, 75 intersect with the guide direction of the bearing member guiding portion 99, the fixing portion 70 cannot enter the bearing member guiding portion 99.

The bearing member receiving portion 100 is formed so as to spread in a circle in sectional view from the bearing member guiding portion 99 at the bottom end portion of the bearing member guiding portion 99. The bearing member receiving portion 100 is formed so that its diameter defining an interior surface of the bearing member receiving portion 100 is substantially the same distance as an interval between the curved side surfaces 76, 77 of the fixing portion 70 of each bearing member 66, 67. In addition, the curvature of the interior surface is substantially the same as the curvature of each curved side surface 76, 77. With this formation, the fixing portion 70 of each bearing member 66, 67 guided by the bearing member guiding portion 99 is rotatably received in the bearing member receiving portion 100.

On an outer surface of each sidewall 92, two engaging recessed portions 102 are formed symmetrically with respect to the bearing member receiving portion 100 so as to face each other at the same distance away as an interval between the two engaging protrusions 72 of each bearing member 66, 67 in the front-rear direction. The recessed portions 102 function as engaged stoppers that are recessed from the outer surface in substantially a rectangular shape in a plan view. On the outer surface of each sidewall 92, a receiving recessed portion 103 is also formed under the bearing member receiving portion 100. The receiving recessed portion 103 is recessed in substantially a rectangular shape in plan view from the outer surface where the engaging protrusions 72 are received when the bearing member receiving portion 100 receives the fixing portion 70.

The left sidewall 92 is formed with an opening 111 for exposing a transfer electrode 113, under the bearing member receiving portion 100.

Further, the left sidewall 92 is provided with a cleaning electrode 104 for applying a cleaning bias to the cleaning brush 33, at the rear of the bearing member receiving portion 100.

As show in FIG. 6, the rear connection portion 93 connects the pair of sidewalls 92 at their rear end portions. The rear connection portion 93 is provided with a wall portion 105 that faces the photosensitive member 29 at the rear thereof. The cleaning brush 33 is attached to the wall portion 105.

The lower front connection portion 94 connects the pair of sidewalls 92 at their lower front end portions. The lower front connection portion 94 includes a register roller accommodating portion 106 for accommodating the upper register roller 14.

The lower rear connection portion 95 connects the pair of sidewalls 92 at their lower rear end portions under the bearing member receiving portion 100, as shown in FIG. 4. The lower rear connection portion 95 includes a transfer roller accommodating portion 107 for accommodating the transfer roller 32, as shown in FIG. 6. In addition, the lower rear connection portion 95 is provided with roller bearings 109 at opposite end portions of the transfer roller accommodating portion 107 with respect to its width, as shown in FIG. 5. The roller bearings 109 receive the opposite end portions of the roller shaft 108 in the transfer roller 32.

The roller shaft 108 is received by the roller bearings 109 at both end portions, so that the transfer roller 32 is rotatably supported by the lower rear connection portion 95.

The roller shaft 108 of the transfer roller 32 protrudes outward from the roller bearings 109 at both end portions. Cover members 110 are attached to both end portions of the roller shaft 108, which protrude outward. The cover members 110 are made of an insulation resin material. The cover members 110 prevent the roller shaft 108 from being exposed at both end portions of the drum body 34, so that discharging from the roller shaft 108 to the drum body 34 can be prevented when the transfer bias is applied.

The left end portion of the roller shaft 108 is covered with a transfer electrode 113 for applying a transfer bias. The transfer electrode 113 is exposed outward to the left via the opening 111 on the left sidewall 92.

The transfer gear 112 is mounted on the roller shaft 108 between the cover member 110 and the transfer electrode 113 in a manner so as to rotate integrally with the roller shaft 108. The transfer gear 112 includes a plurality of external teeth that protrude outward with respect to the radial direction to mesh with the output gear 86 of the left flange member 79. With this structure, when the photosensitive member 29 is rotated by a driving force from a motor (not shown) provided in the main casing 2, the output gear 86 of the left flange member 79 attached to the photosensitive member 29 is rotated. Concurrently, the transfer gear 112 in mesh with the output gear 86 is rotated, and the transfer roller 32 is rotated.

Figure 9:
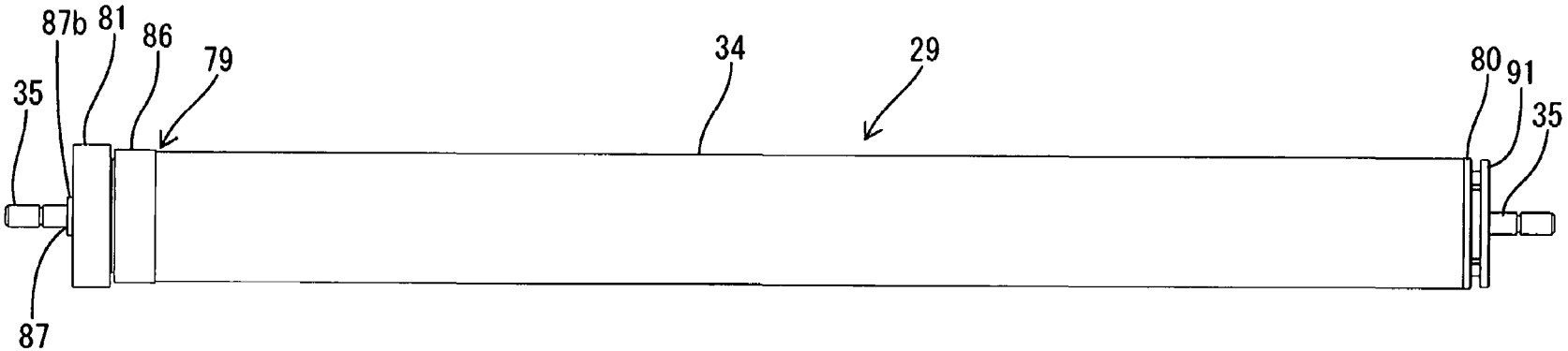
FIG. 9 is a plan view of a photosensitive member in accordance with aspects of the present invention.

Next, a structure for attaching the photosensitive member 29 to the frame will be described below. FIG. 9 is a plan view of the photosensitive member 29; and FIGS. 10 and 11 are perspective views of the upper frame 27 and the lower frame 28 which are joined to each other, when viewed from the front with respect to different angles. In FIGS. 10 and 11, the photosensitive member 29 is not mounted to the upper frame 27. The photosensitive member 29 (FIG. 9) is to be mounted to the upper frame 27 by using an attaching method (described later) such that the drum body 34 of the photosensitive member 29 is to be disposed between the left lower side plate portion 57 and the right sidewall 55 in the upper frame 27.

As shown in FIG. 9, the drum gear 81 and the output gear 86 are attached to the left end portion of the photosensitive member 29 in the longitudinal direction of the drum shaft 34. As described later, after the photosensitive member 29 is placed in the upper frame 27, the drum shaft 35 is inserted into the drum body 34, the drum gear 81 and the output gear 86, so as to pass through their bodies in the longitudinal direction of the drum body 34. Both the end portions of the drum shaft 35 are supported by the left lower side plate portion 57 and the right sidewall 55 of the upper frame 27, respectively, as shown in FIG. 5. As shown in FIGS. 10 and 11, the upper frame 27 is joined to the lower frame 28 such that the left lower side plate portion 57 and the right sidewall 55 of the upper frame 27 are supported by the lower frame 28, inside between the sidewalls 92 of the lower frame 28, and the photosensitive member 29 is mounted such that the photosensitive drum 34 is disposed further inside between the left lower side plate portion 57 and the right sidewall 55.

Figure 12A:
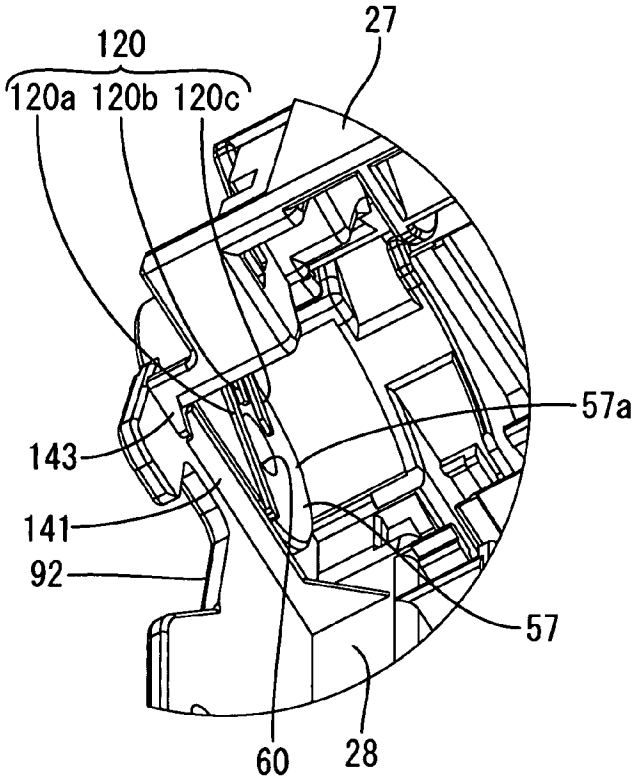
FIG. 12A is an enlarged view of a vicinity of a left lower side plate portion of the upper frame of FIG. 10 in accordance with aspects of the present invention.
Figure 12B:
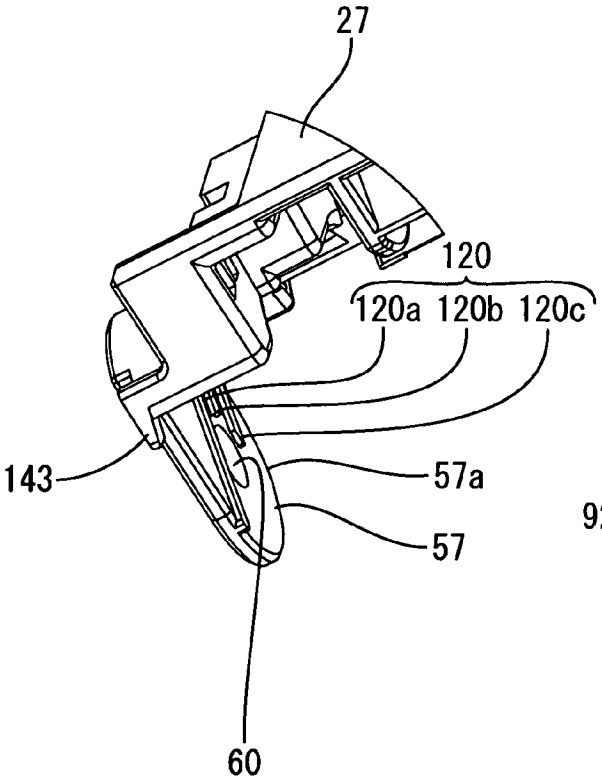
FIG. 12B illustrates the upper frame shown in FIG. 12A in accordance with aspects of the present invention.
Figure 12C:
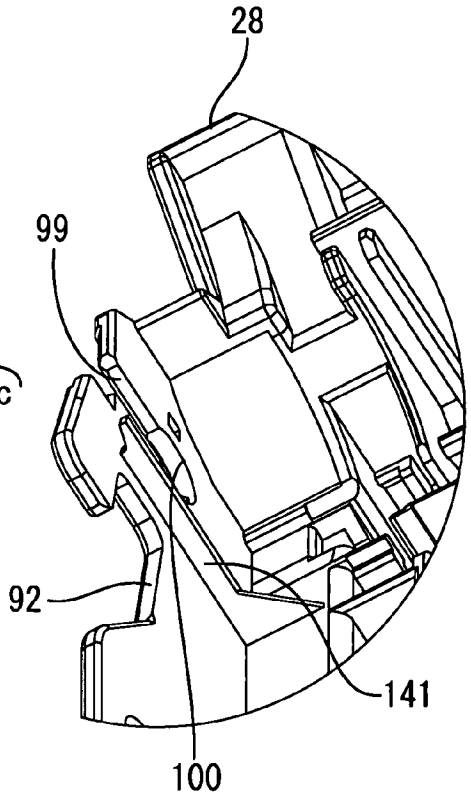
FIG. 12C illustrates the lower frame shown in FIG. 12A in accordance with aspects of the present invention.

FIG. 12A is an enlarged view showing a vicinity of the left lower side plate portion 57 of FIG. 10. FIG. 12B illustrates the upper frame 27 of FIG. 12A. FIG. 12C illustrates the lower frame 28 of FIG. 12A. The left lower side plate portion 57 functions as a gear-side supporting portion. The left lower side plate portion 57 is formed with the second insertion hole 60 through which the drum shaft 35 passes. A positioning rib 120 (functioning as a positioning member) is provided so as to protrude toward the inside from an inner surface 57*a* of the left lower side plate portion 57 in the longitudinal direction of the photosensitive member 29. The inner surface 57*a* of the left lower side plate portion 57 faces the end portion of the drum body 34 when the photosensitive member 29 is mounted to the upper frame 27. The positioning rib 120 is provided to position a projecting portion 87*b* (FIG. 13) of the drum gear 81 at a predetermined position.

Figure 13:
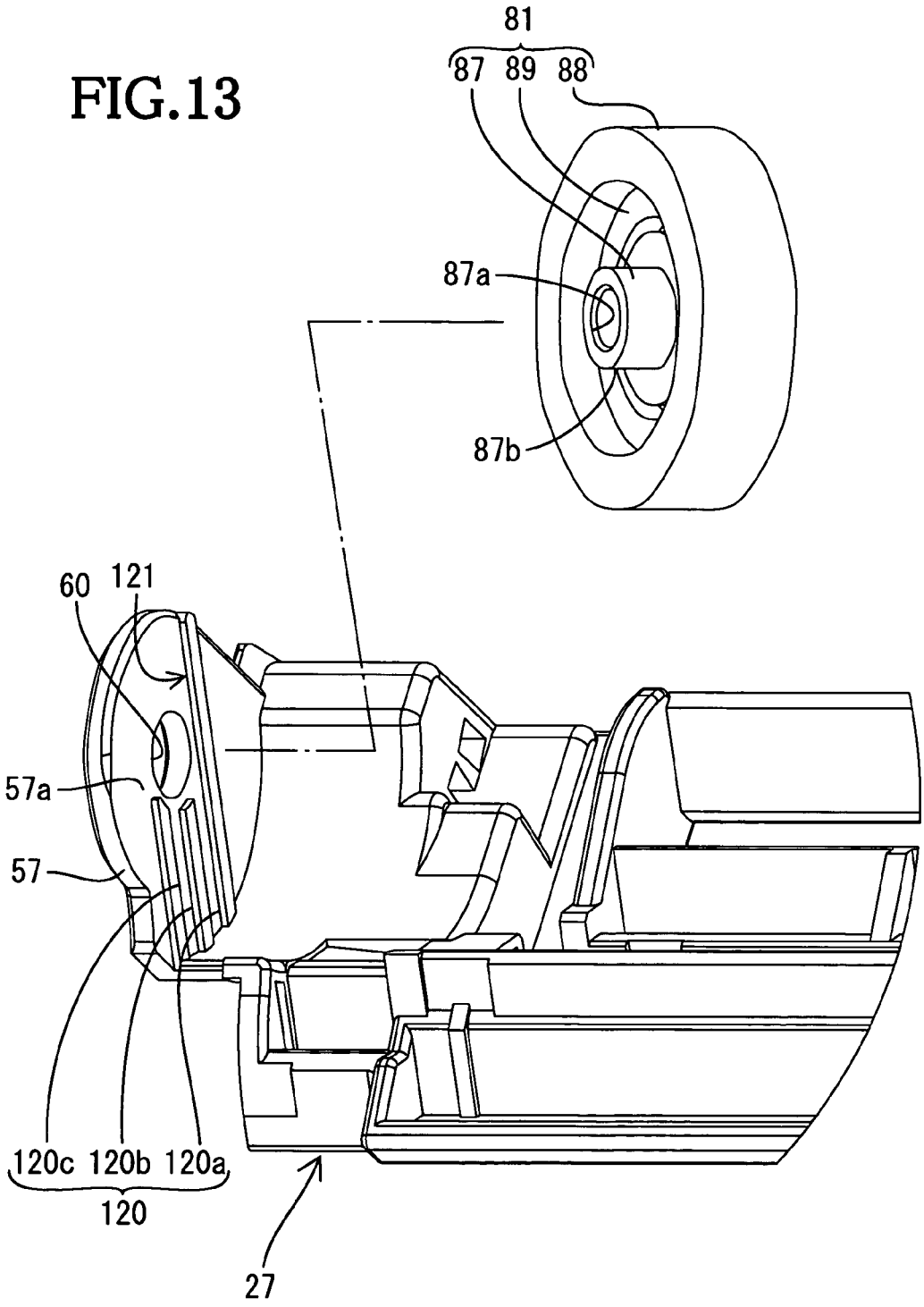
FIG. 13 shows how to position a drum gear with respect to the left lower side plate portion in accordance with aspects of the present invention.

FIG. 13 shows how to position the drum gear 81 with respect to the left lower side plate portion 57. In FIG. 13, the upper frame 27 and the drum gear 81 are perspectively shown with respect to different directions while the flange portion 79 to be joined to the drum gear 81 is omitted from the drawing and the upper frame 27 is upside down so that its top horizontal portion 64 is situated at the bottom side. As shown in FIG. 13, the gear bearing portion 87 of the drum gear 81 includes a first insertion hole 87*a* and the projecting portion 87*b*. The drum shaft 35 is to be inserted into the first insertion hole 87*a* of the drum gear 81. The projecting portion 87*b* is provided to protrude toward the outside from an outer surface of the drum gear 81. The outer surface of the drum gear 81 is a side opposite to the inner surface 57*a* that faces the end portion of the drum body 34. The positioning rib 120 includes a first rib 120*a*, a second rib 120*b*, and a third rib 120*c*, which protrude from the inner surface 57*a* of the drum gear 81 at predetermined intervals and extend in parallel with each other.

Figure 14:
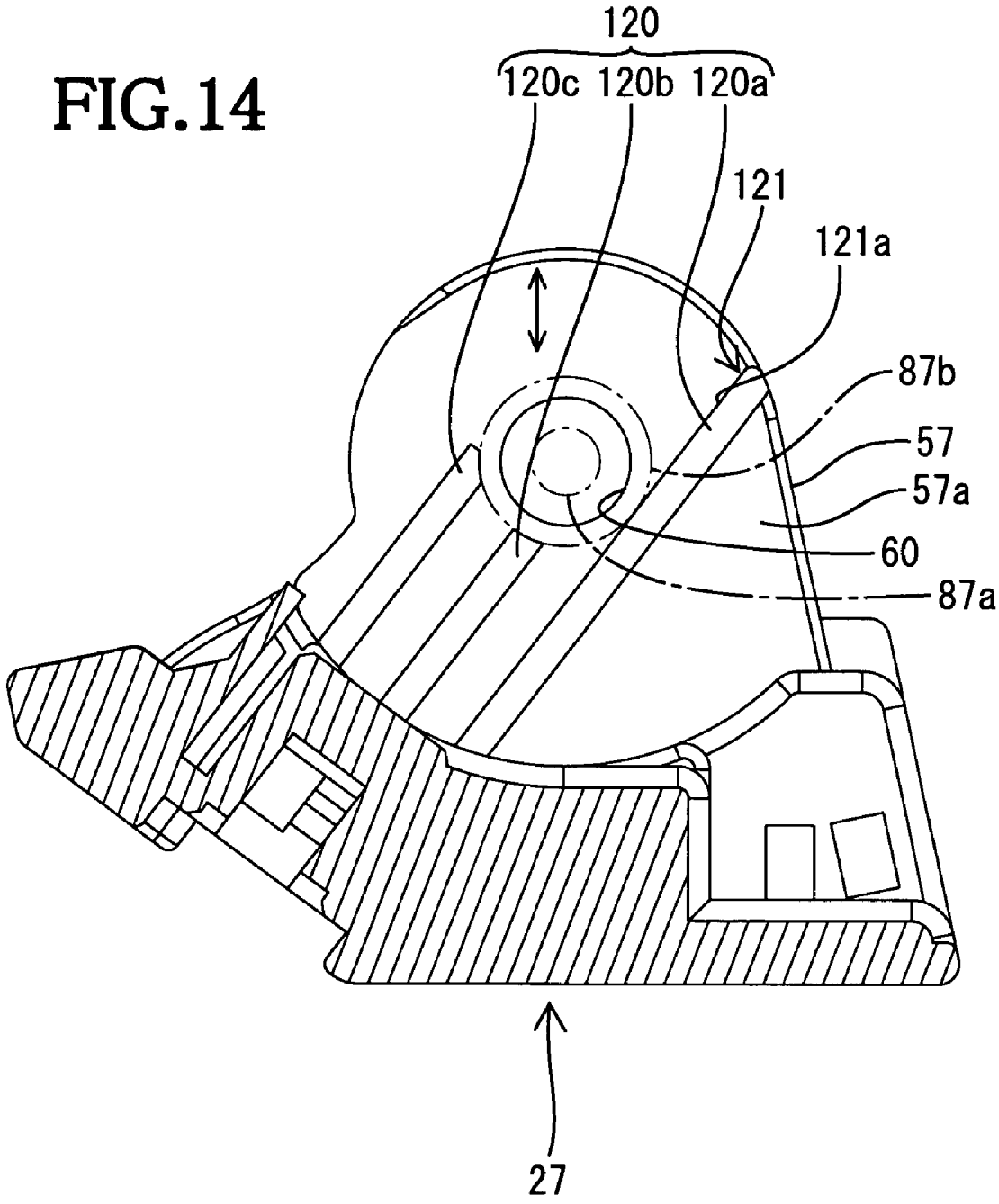
FIG. 14 is a partial sectional view of an inner surface side of the left lower side plate portion when viewed from a longitudinal direction of the upper frame in accordance with aspects of the present invention.

FIG. 14 is a partial sectional view of the inside of the left lower side plate portion 57 with respect to the longitudinal direction of the photosensitive member 29. In FIG. 14, predetermined positions where the projecting portion 87*b* of the drum gear 81 and the first insertion hole 87*a* of the left lower side plate portion 57 are to be positioned are shown by a dot and dashed line. As shown in FIG. 14, the positioning rib 120 is arranged such that a side portion of the first rib 120*a*, an end portion of the second rib 120*b*, and an end portion of the third rib 120*c* support the projecting portion 87*b* of the drum gear 81. In a state where the projecting portion 87*b* of the drum gear 81 is positioned at the predetermined position by the positioning rib 120, an opening of the first insertion hole 87*a* and an opening of the second insertion hole 60 overlap one another within a range in which the drum shaft 35 can be inserted into both the first insertion hole 87*a* and the second insertion hole 60. That is, by positioning the projecting portion 87*b* at the predetermined position by the positioning rib 120 provided at the frame, the first insertion hole 87*a* provided on the gear side and the second insertion hole 60 provided on the frame side are maintained at an appropriate position where the drum shaft 35 can be inserted thereto.

As shown in FIG. 14, the positioning rib 120 is arranged so as to restrict the movement of the projecting portion 87*b* of the drum gear 81. More specifically, the projecting portion 87*b* positioned at the predetermined position can move relative to the positioning rib 120 in a specific insertion/removal direction (indicated by a double-headed arrow in FIG. 14) with respect to a direction extending along the inner surface 57*a* of the left lower side plate portion 57 while being prevented from moving relative to the positioning rib 120 in directions other than the specific insertion/removal direction. Therefore, the relative movement between the projecting portion 87*b* and the positioning rib 120 in the directions other than the specific insertion/removal direction is restricted in the direction along the inner surface 57*a* of left lower side plate portion 57, and the projecting portion 87*b* is stably maintained at the position on the left lower side plate portion 57. With this structure, the displacement between the first insertion hole 87*a* provided on the gear side and the second insertion hole 60 provided on the frame side is prevented.

As shown in FIGS. 13 and 14, the first rib 120*a* of the positioning rib 120 is provided with a guiding portion 121 that guides the projecting portion 87*b* to the predetermined position. More specifically, the guiding portion 121 is a part of one end portion of the first rib 120*a* and has a side surface 121*a* that guides the projecting portion 87*b*. That is, when the drum gear 81 is attached to the frame, if the projecting portion 87*b* of the drum gear 81 is brought into contact with any position of the side surface 121*a* of the guiding portion 121, the projecting portion 87*b* can be easily guided to the predetermined position (i.e., the position indicated by the dot and dashed line in FIG. 14) along the side surface 121*a* of the guiding portion 121.

Figure 15:
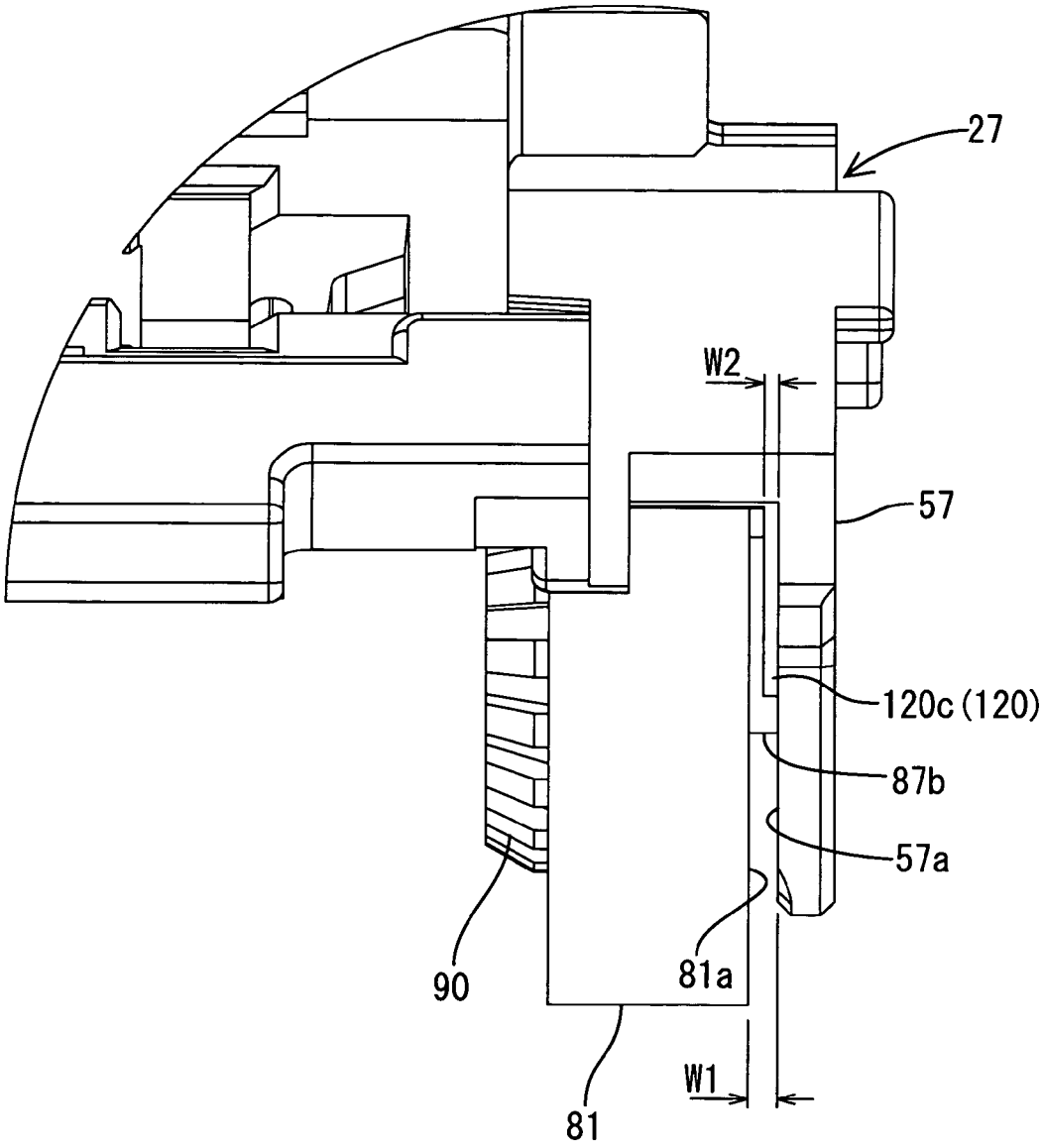
FIG. 15 represents a relationship between a projecting portion of the drum gear and a positioning member in accordance with aspects of the present invention.

FIG. 15 is a rear view of the upper frame 27 in which the projecting portion 87*b* of the drum gear 81 is positioned at the predetermined position by the positioning rib 120. In FIG. 15, the flange portion 79 to be joined to the drum gear 81 is omitted from the drawing. As shown in FIG. 15, a protruding amount W1 of the projecting portion 87*b* is greater than a protruding amount W2 of the positioning rib 120 in the longitudinal direction of the photosensitive member 29. Therefore, when the projecting portion 87*b* is positioned at the predetermined position as shown in FIG. 15, a side surface 81*a* of the drum gear 81 does not contact the positioning rib 120. Thus, rotation accuracy of the drum gear 81 is increased (and by extension, rotation accuracy of the photosensitive member 29 is increased) and a noise traceable to rubbing between the drum gear 81 and the left lower side plate portion 57 is prevented from occurring.

Figure 16:
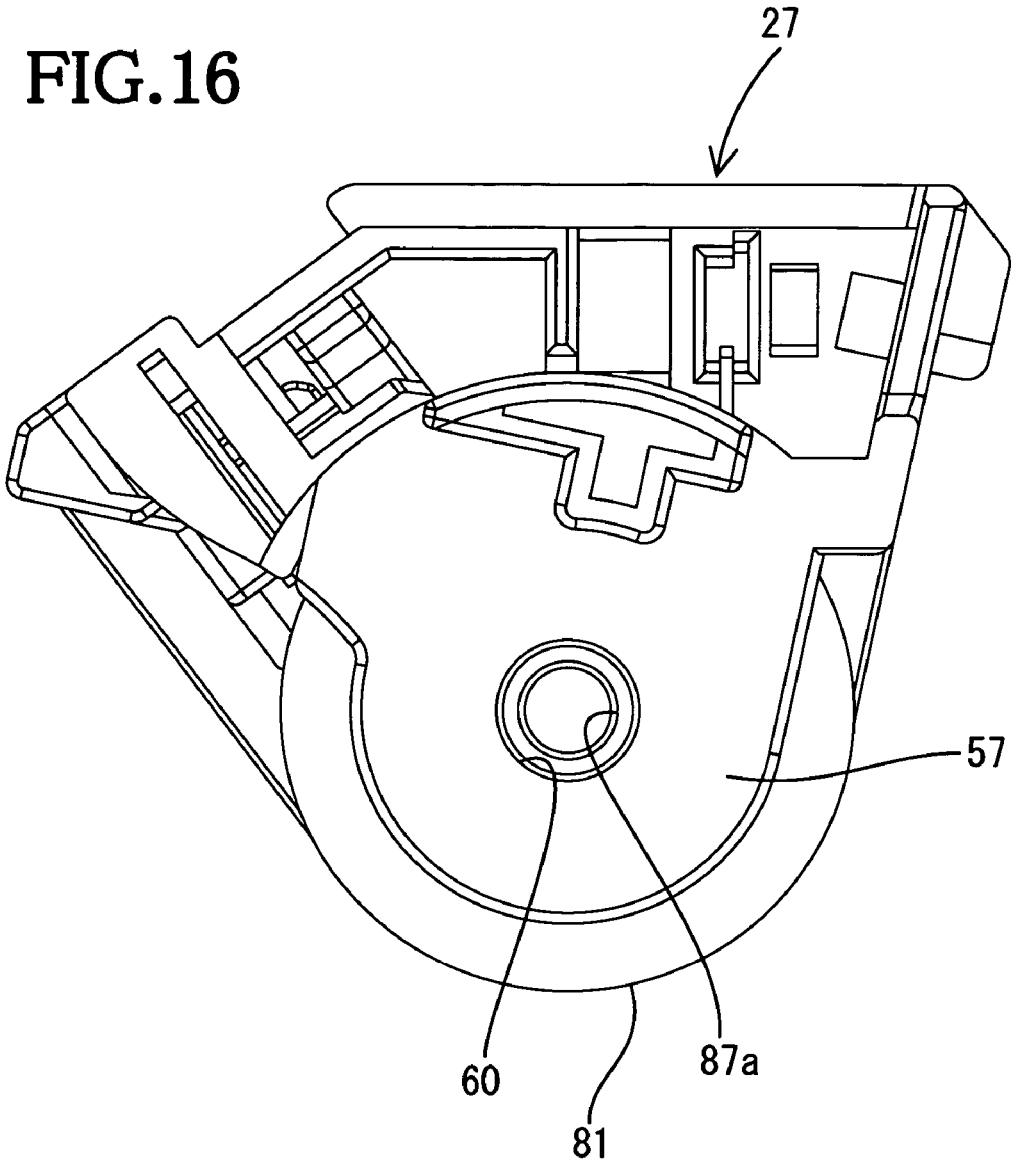
FIG. 16 is a side view of the upper frame wherein the drum gear is positioned at the left lower side plate portion in accordance with aspects of the present invention.

FIG. 16 is a side view of the upper flame 27 wherein the projecting portion 87*b* of the drum gear 81 is positioned at the predetermined position by the positioning member 121, when viewed from the left lower side plate portion 57 side in the longitudinal direction of the photosensitive member 29. In this illustrative embodiment, as shown in FIG. 16, the opening size of the second insertion hole 60 is larger than the opening size of the first insertion hole 87*a*. In other words, a diameter of the circular second insertion hole 60 is greater than a diameter of the circular first insertion hole 87*a*. With this structure, the opening of the first insertion hole 87*a* and the opening of the second insertion hole 60 overlap each other in the range where the drum shaft 35 can be inserted thereto. In FIG. 16, a center of the first insertion hole 87*a* and a center of the second insertion hole 60 are substantially aligned with each other. Alternatively, the centers of the first insertion hole 87*a* and the second insertion hole 60 may be displaced from each other to the extent that the drum shaft 35 can be inserted thereto. In this illustrative embodiment, in order to increase the rotation accuracy of the drum body 34 of the photosensitive member 29, the inside diameter of the first insertion hole 87*a* is substantially equal to the outside diameter of the drum shaft 35. Alternatively, those diameters may be slightly different from each other.

While the projecting portion 87*b* of the drum gear 81 is positioned at the predetermined position by the positioning rib 120 as shown in FIGS. 14 to 16, the drum shaft 35 is inserted into the second insertion hole 60 and the first insertion hole 87*a*. The bearing member 66 (functioning as a bearing portion), which rotatably supports the drum shaft 35, is fitted to the second insertion hole 60. That is, the inside diameter of the second insertion hole 60 is larger than the outside diameter of the drum shaft 35, so that clearance is formed between the inner surface of the second insertion hole 60 and the outer surface of the drum shaft 35. Thus, the shaft insertion portion 68 of the bearing member 66 is fitted in the clearance between the second insertion hole 60 and the drum shaft 35.

Figure 17:
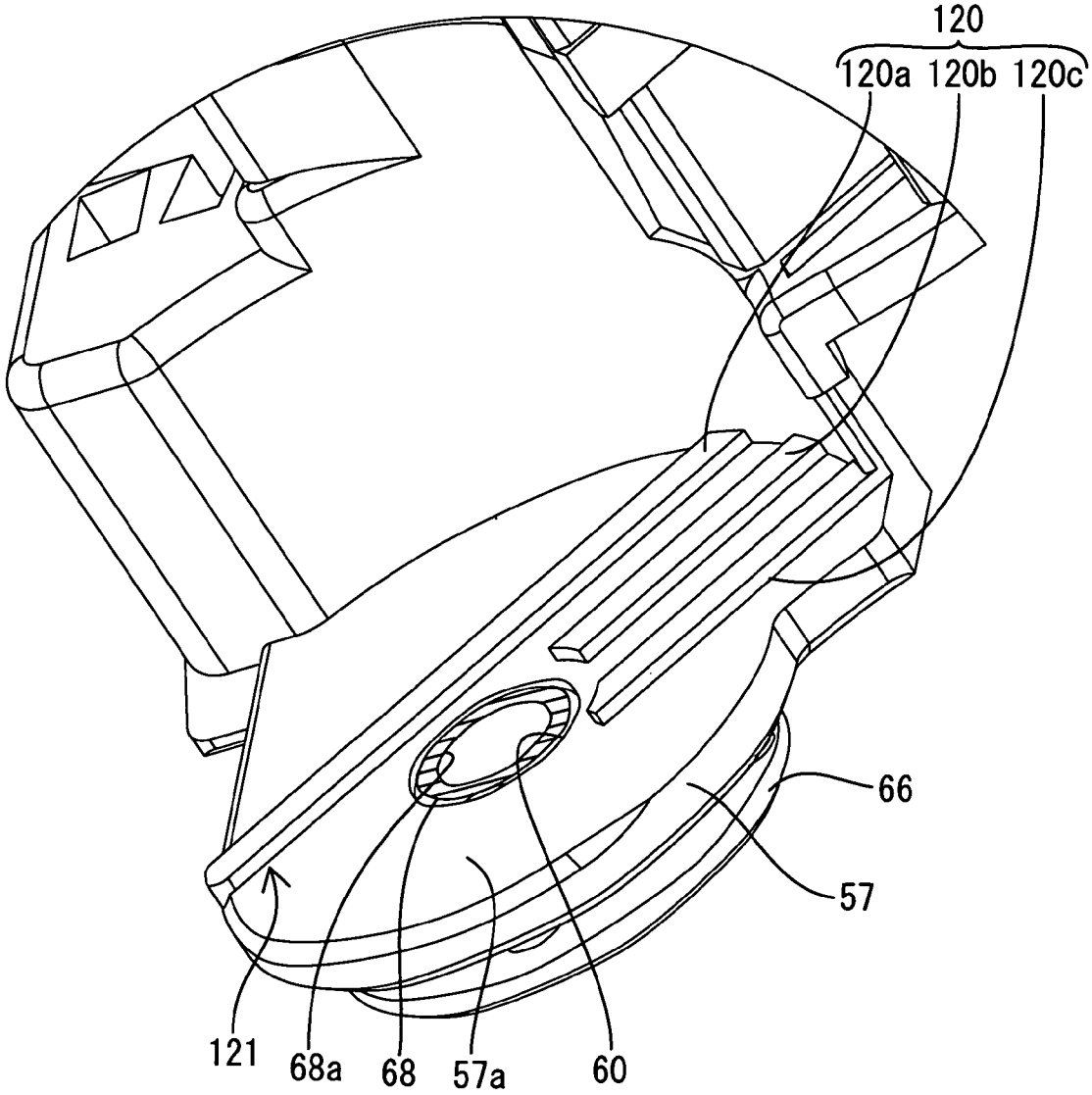
FIG. 17 represents a relationship between the left lower side plate portion and the bearing member with a shaft insertion portion being fitted in a second insertion hole in accordance with aspects of the present invention.

FIG. 17 illustrates a state where the shaft insertion portion 68 is fitted in the second insertion hole 60. When the photosensitive member 29 is mounted to the frame, the drum shaft 35 passes through a hole 68*a* of the shaft insertion portion 68. First, the drum shaft 35 is inserted into the second insertion hole 60 and the first insertion hole 87*a* while the projecting portion 87 of the drum gear 81 is positioned by the positioning rib 120. Then, the drum shaft 35, which protrudes toward the outside from the left lower side plate portion 57, is inserted into the hole 68*a* of the shaft insertion portion 68 to attach the bearing member 66 to the drum shaft 35. The inside diameter of the hole 68*a* of the shaft insertion portion 68 is substantially the same as the outside diameter of the drum shaft 35, and the outside diameter of the shaft insertion portion 68 is substantially the same as the inside diameter of the second insertion hole 60. The end portion of the drum shaft 35, which passes through the second insertion hole 60, the first insertion hole 87*a* and the hole 68*a* of the shaft insertion portion 68, is locked by the locking member 78 so as not to disengage therefrom.

Figure 18:
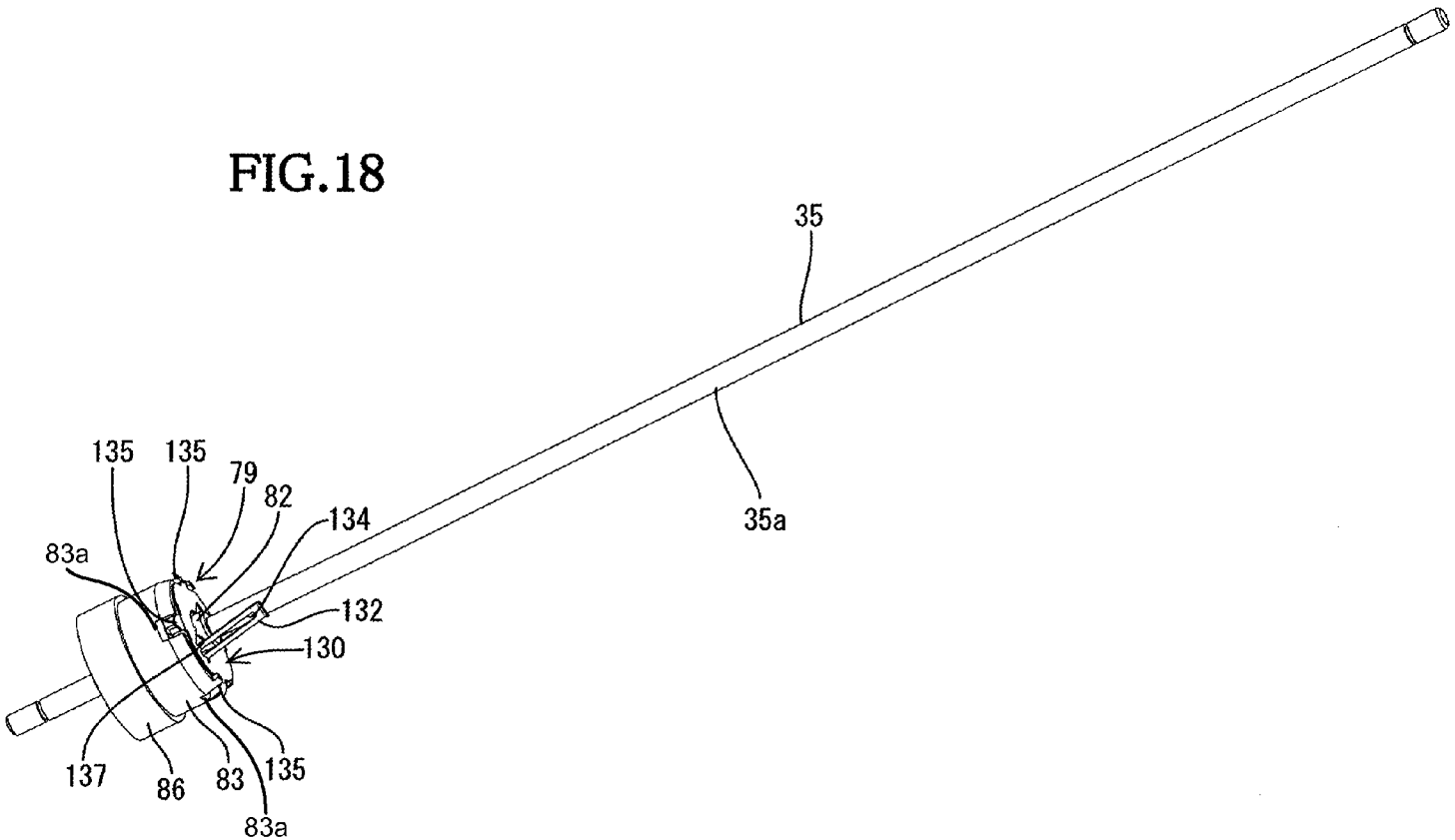
FIG. 18 is a perspective view showing a relationship between a flange member, a metal member and a drum shaft in accordance with aspects of the present invention.

Next, an internal structure of the photosensitive member 29 will be described with reference to FIGS. 18 to 20. In FIGS. 18 to 20, the drum gear 81 to be joined to the flange member 79 is omitted from the drawings.

The drum body 34 has a hollow body, as shown in FIG. 5. An inner surface 34*a* of the drum body 34 and an outer surface 35*a* of the drum shaft 35 are both made of a conductive material. As shown in FIGS. 5 and 18, a plate-shaped metal member 130 is provided in order to electrically connect the inner surface 34*a* of the drum body 34 and the outer surface 35*a* of the drum shaft 35 with each other.

The metal member 130 has a substantially circular flat-plate portion 131. The flat-plate-portion 131 is formed with an opening 137 at its substantially center portion. An elastically deformable contact portion 132 is provided so as to protrude from a portion of an edge of the opening 137. The contact portion 132 is formed with an opening 134, which penetrates the contact portion 132 in its thickness direction. This structure provides the contact portion 132 with an elastic force. A free end of the contact portion 132 is bent to form a curved portion 132*a*. The flat-plate portion 131 includes four pawl portions 135 at its rim. The pawl portions 135 protrude from the flat-plate portion 131 at intervals of 90 degrees.

The insertion portion 83 of the flange member 79 is provided with four cutaway portions 83*a* at its rim at intervals of 90 degrees in order to receive the respective pawl portions 135 therein.

The pawl portions 135 of the metal member 130 are aligned with the respective cutaway portions 83*a* of the flange member 79 and then a part of the flange shaft receiving portion 82 is inserted into the opening 137 of the flat-plate portion 131. Thus, the metal member 130 and the flange member 79 are engaged with each other.

Figure 19A:
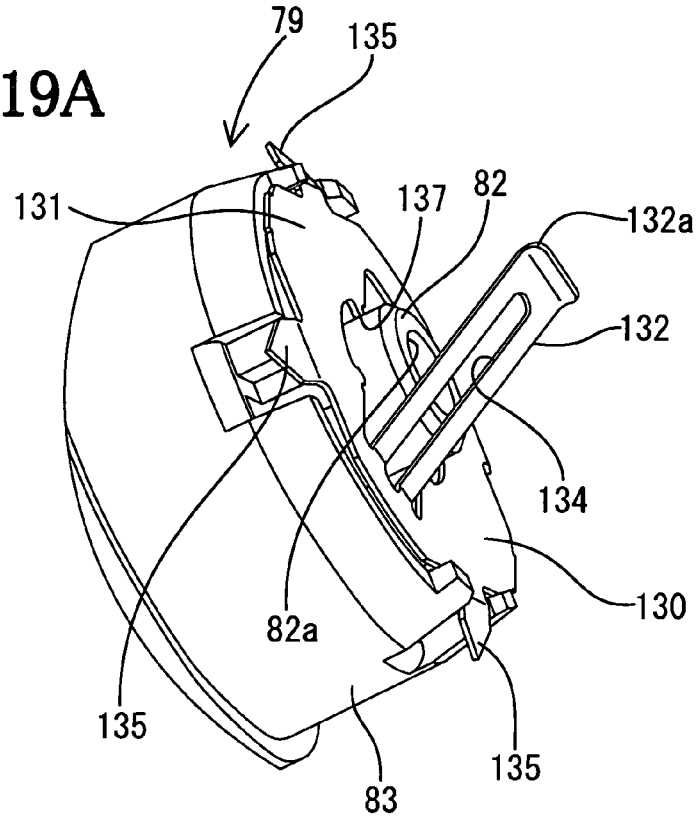
FIG. 19A is a perspective view showing the flange member and the metal member, into which the drum shaft is not inserted in accordance with aspects of the present invention.
Figure 19B:
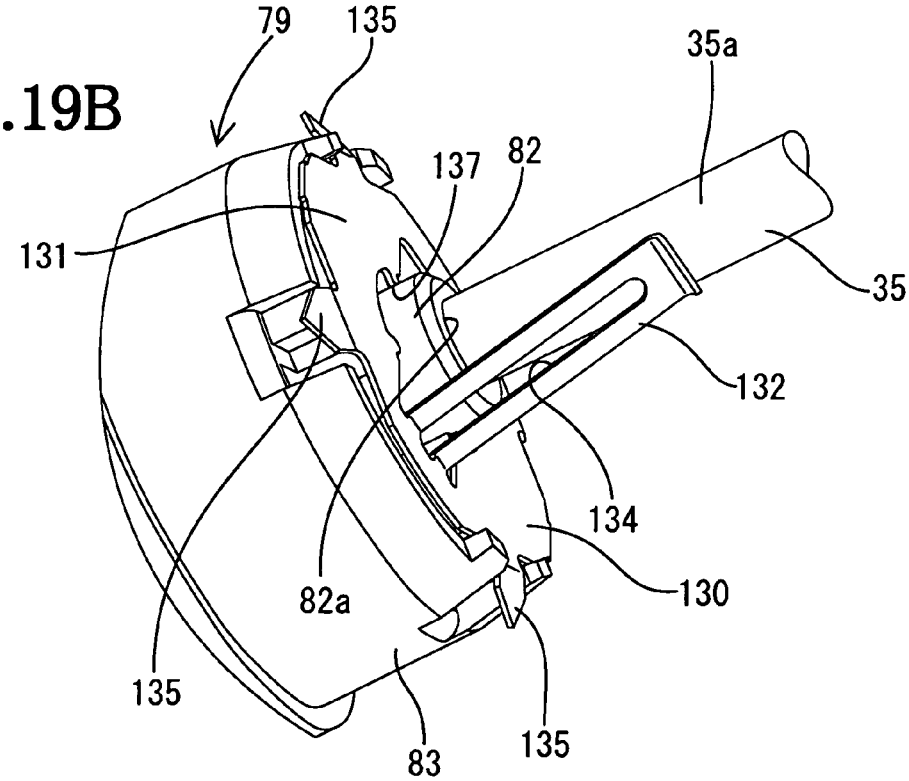
FIG. 19B is a perspective view showing the flange member and the metal member, into which the drum shaft is inserted in accordance with aspects of the present invention.
Figure 20A:
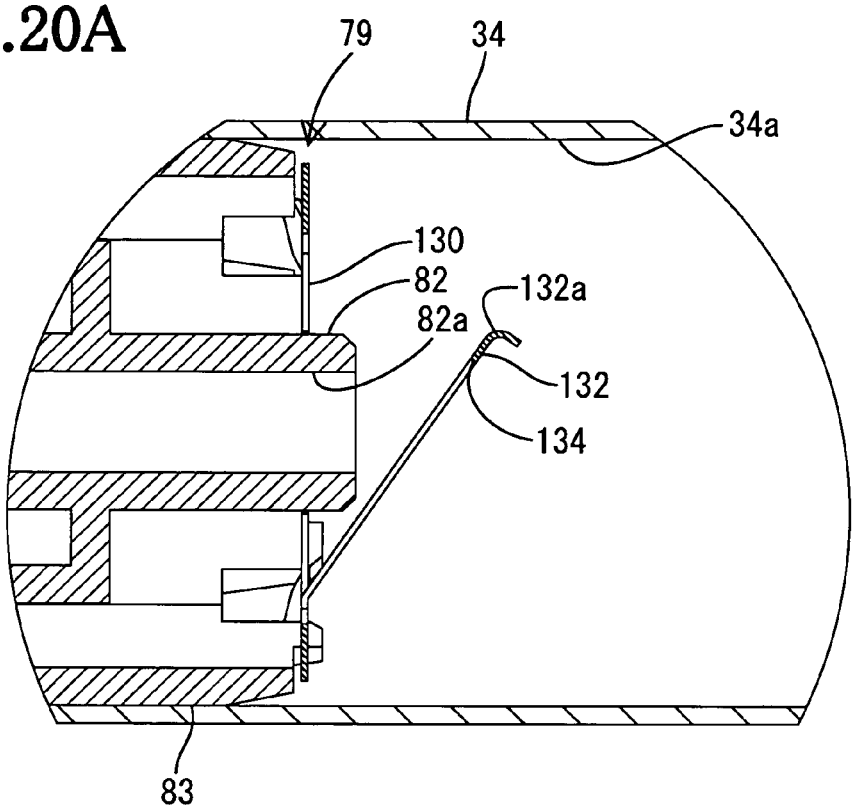
FIG. 20A is a sectional view showing the flange member and the metal member, into which the drum shaft is not inserted in accordance with aspects of the present invention.
Figure 20B:
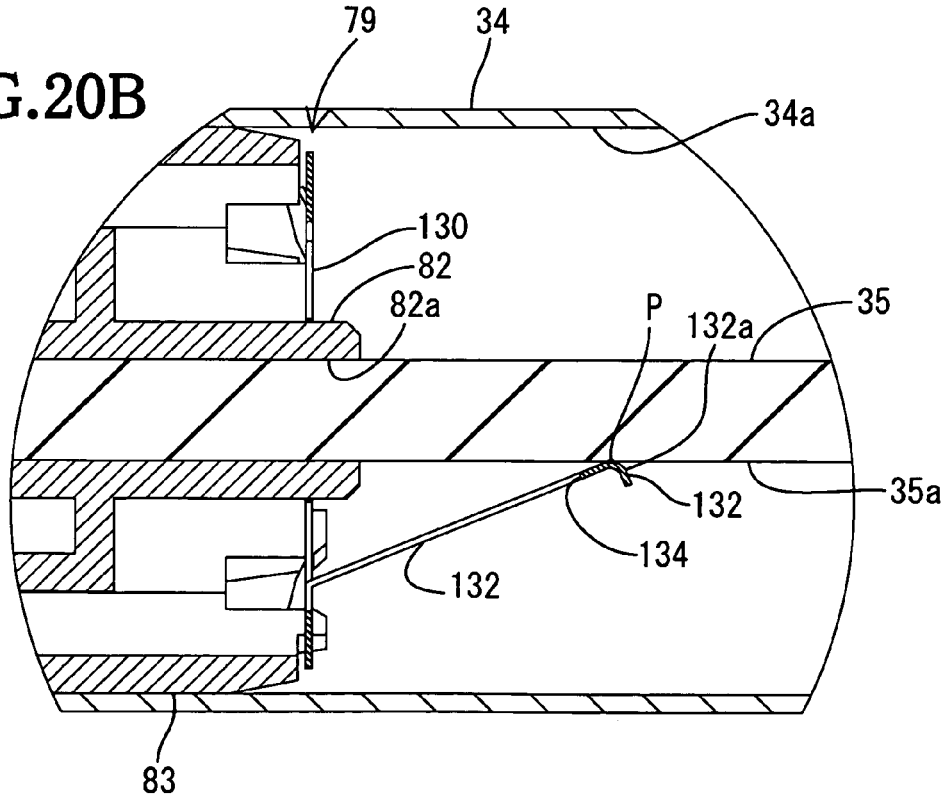
FIG. 20B is a sectional view showing the flange member and the metal member, into which the drum shaft is inserted in accordance with aspects of the present invention.

As shown in FIGS. 19A and 20A, when the drum shaft 35 is not inserted into a hole 82*a* of the flange member 79, no force is exerted on the contact portion 132 and the contact portion 132 is inclined to a position so as to place over the hole 82*a* of the flange shaft receiving portion 82. As shown in FIGS. 18, 19B and 20B, when the drum shaft 35 is inserted into the hole 82*a* of the flange member 79, the contact portion 132 is elastically deformed and the curved portion 132*a* contacts the outer surface 35*a* of the drum shaft 35. At that time, by an elastic return force of the contact portion 132, the curved portion 132*a* of the contact portion 132 is urged in a direction to press the outer surface 35*a* of the drum shaft 35.

When the flange member 79 is inserted into the drum body 34, the insertion portion 83 of the flange member 79 intimately contacts the inner surface 34*a* of the drum body 34 and the pawl portions 135 are held by the flange member 79 while being in contact with the inner surface 34*a* of the drum body 34. Thus, the drum shaft 35 and the drum body 34 are electrically connected with each other via the metal member 130. The drum shaft 35 is grounded via a terminal (not shown), so that the inner surface 34*a* of the drum body 34 is connected to ground.

In this structure, the contact portion 132 is formed with the opening 134 to regulate its elastic force, so that the curved portion 132*a* of the contact portion 132 and the drum shaft 35 can be contacted with each other by an appropriate force. Thus, a rubbing sound and a wearing down of the metal member 130 traceable to the contact of the drum shaft 35 and the metal member 130 can be prevented. In addition, the elastic force of the contact portion 132 is regulated by providing the opening 134 in the contact portion 132, so that the contact portion 132 of this illustrative embodiment is resistant to friction as compared with a contact portion having a structure in which the elastic force is regulated by thinning the metal member 130.

As shown in FIG. 20B, the curved portion 132*a* of the contact portion 132 contacts the outer surface 35*a* of the drum shaft 35. The contact portion 132 is formed with the opening 134 such that the edge of the opening 134 is not located at a contact position P where the curved portion 132*a* contacts the drum shaft 35. That is, the edge of the opening 134 and the outer surface 35*a* of the drum shaft 35 are separated from each other at a predetermined distance when the curved portion 132*a* and the drum shaft 35 are contacted with each other. As described above, a thick portion of the contact portion 132 and the outer surface 35*a* of the drum shaft 35 are contacted with each other, so that the contact portion 132 and the drum shaft 35 can be stably contacted with each other.

Figure 25A:
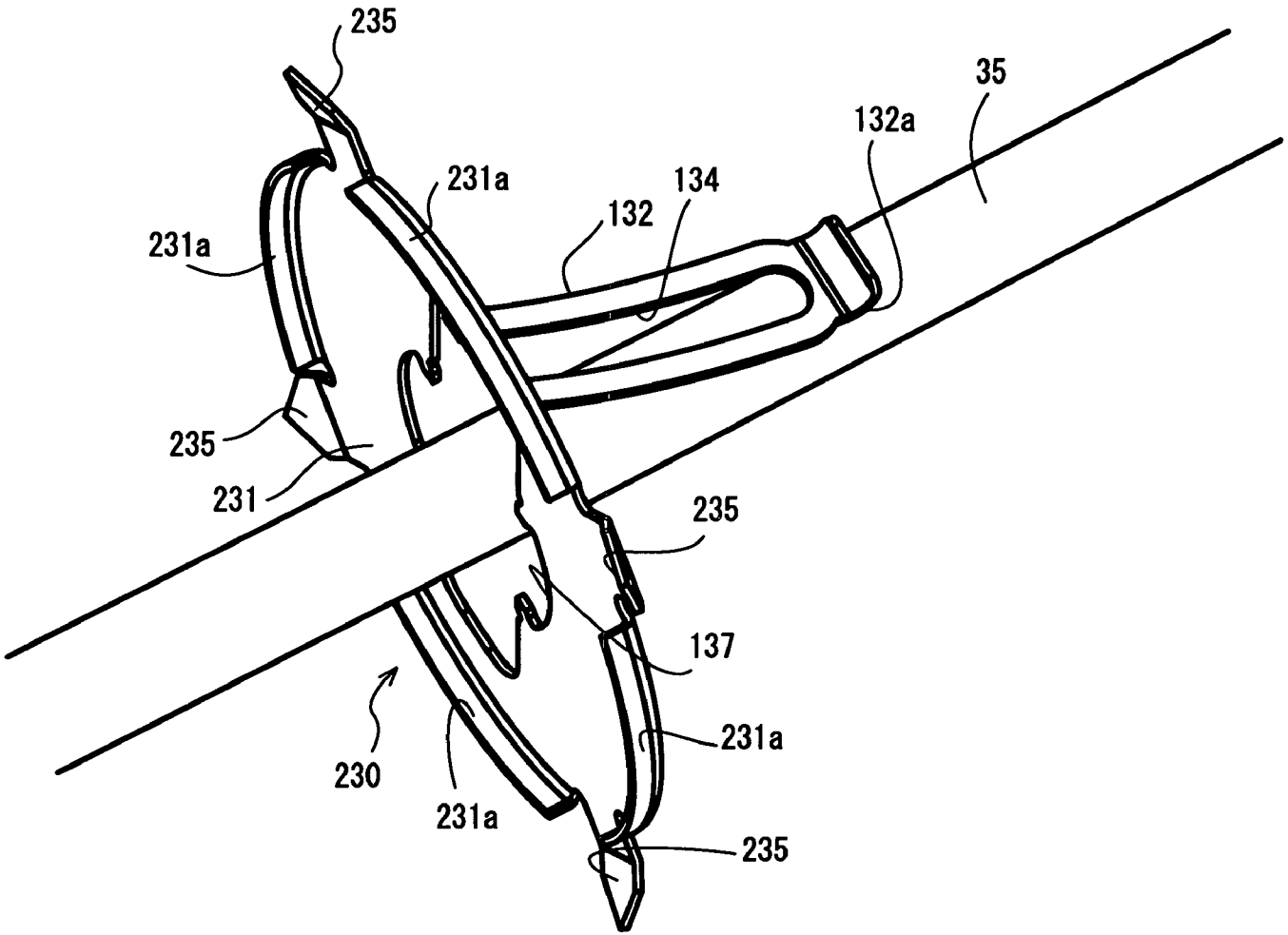
FIG. 25A illustrates a variation of the metal member in accordance with aspects of the present invention.

FIG. 25A illustrates a first variation of the metal member 130. A metal member 230 of the first variation has the substantially same structure as the metal member 130 of the above-described illustrative embodiment. There is a difference between the metal member 130 of the illustrative embodiment and the metal member 230 of the first variation in which the metal member 230 includes reinforcing portions 231*a*. The reinforcing portions 231*a* are formed by bending, at substantially 90 degrees, portions of a rim of a flat-plate portion 231 of the metal member 230 where pawl portions 235 are not provided. The other portions of the metal member 230 are the same as those of the meal member 130, so that the same portions are designated with the same reference numerals and explanations for those portions will be omitted.

According to the above-described illustrative embodiment, the elastic force of the contact portion 132 is regulated by providing the opening 134 in the contact portion 132. With this structure, although the rubbing sound and the wearing down of the metal member 130 can be prevented, the regulation of the elastic force of the contact portion 132 may decrease the contact stability between the contact portion 132 and the drum shaft 35.

On the other hand, according to the metal member 230 of the first variation, the provision of the reinforcing portions 231*a* to the flat-plate portion 231 increases the strength of the flat-plate portion 231. Therefore, the position P where the curved portion 132*a* of the contact portion 132 and the drum shaft 35 are contacted with each other can be further stably maintained when the metal member 230 is rotated in accordance with the rotation of the drum body 34.

Figure 25B:
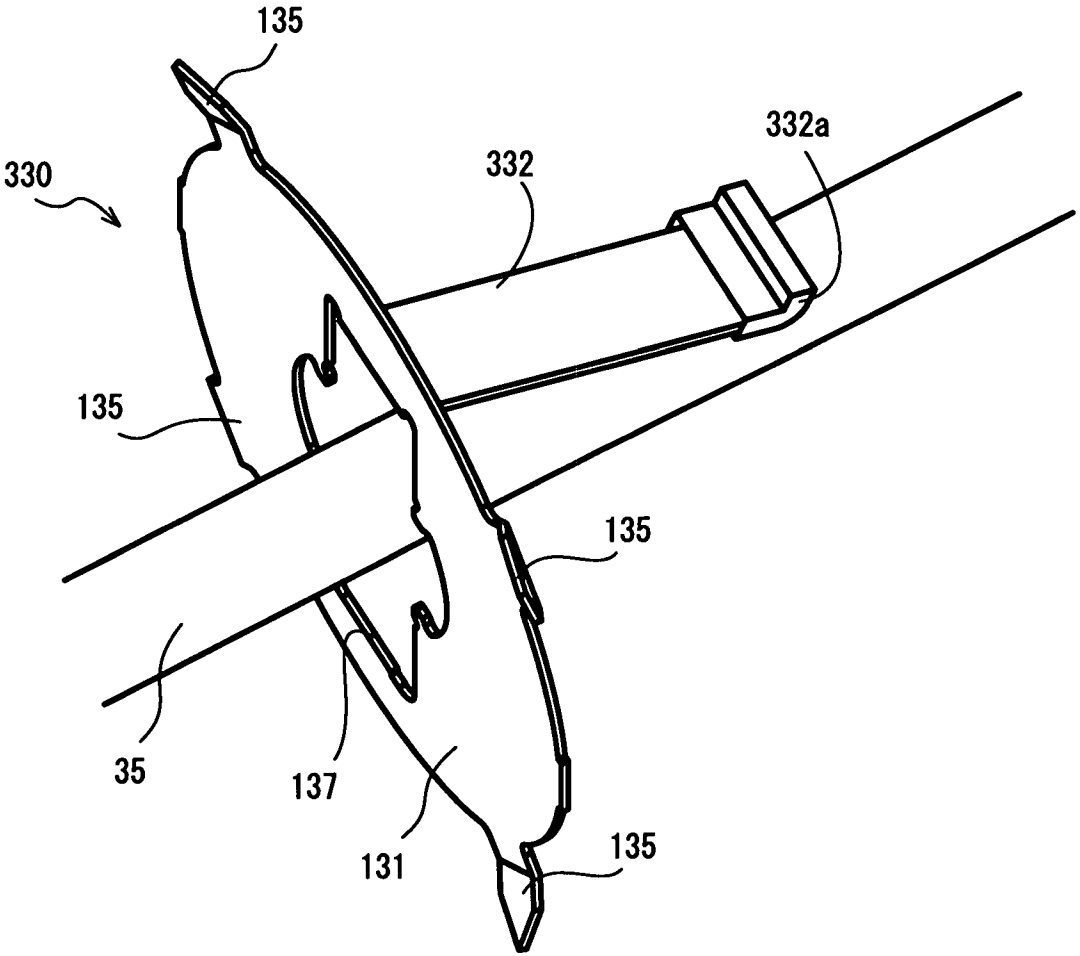
FIG. 25B illustrates another variation of the metal member in accordance with aspects of the present invention.

FIG. 25B illustrates a second variation of the metal member 130. A metal member 330 of the second variation has the substantially same structure as the metal member 130 of the above-described illustrative embodiment. There is a difference between the metal member 130 of the illustrative embodiment and the metal member 330 of the second variation in which the metal member 330 is not provided with an opening in a contact portion 332 and has a cap 332*a*, made of a conductive resin, at a bent free end of the contact portion 332. The other portions of the metal member 330 are the same as those of the meal member 130, so that the same portions are designated with the same reference numerals and explanations for those portions will be omitted.

According to the metal member 330 of the second variation, the contact portion 332 does not have any opening therein, so that an elastic force of the contact portion with respect to the drum shaft 35 increases and the contact stability between the contact portion 332 and the drum shaft 35 is improved. In addition, the cap 332*a* made of resin is provided at the free end of the contact portion 332, so that the wearing down of the contact portion 332 can be prevented as well as the rubbing sound. Although the cap 332*a* is likely to wear out because of being made of resin, as compared with a cap made of metal, the resin-made cap 332*a* can be easily replaced with a new one and the life of the metal member 330 can be extended.

Next, a structure of the right side portion of the photosensitive member 29 will be described with reference to FIGS. 21 to 24C.

As shown in FIGS. 5 and 21, the flange member 80 (functioning as a first flange portion) is attached to the right end portion of the photosensitive member 29 in the longitudinal direction of drum body 34. The spring receiving member 91 (functioning as a second flange portion) is provided outside the flange member 80 in the longitudinal direction of the drum body 34. The spring receiving member 91 is engageable with the flange member 80. A spring 202 (functioning as an urging member) is provided between the flange member 80 and the spring receiving member 91. The spring 202 is a coil compression spring and urges the flange member 80 and the spring receiving member 91 to make them separate from each other in the longitudinal direction of the drum body 34.

As shown in FIG. 21, the spring receiving member 91 is designed so as to be capable of relatively moving in a direction to close to the flange member 80 against the spring 202. Further, an outer surface 91*a* of the spring receiving member 91 is supported by the right sidewall 55 opposite to the left lower side plate portion 57. With this structure, the drum body 34, to which the flange member 80 is attached, is urged in a direction to close to the left lower side plate portion 57 (FIG. 5). Therefore, the drum body 34 is always urged in the direction to close to the gear-side supporting portion, so that the drum body 34 can stably rotate without significantly sliding in its longitudinal direction.

Figure 22C:
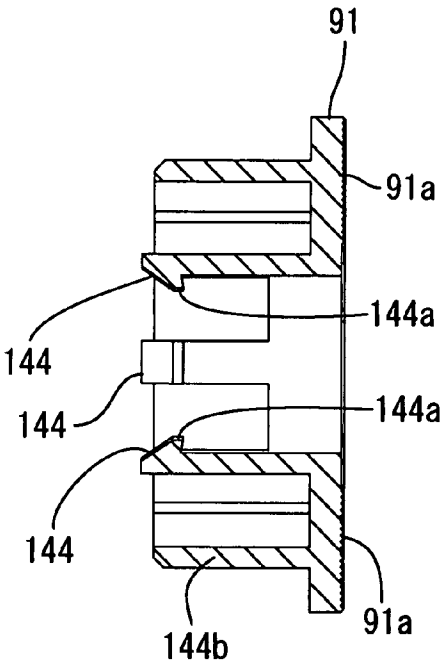
FIG. 22C is a sectional view of a spring receiving member in accordance with aspects of the present invention.
Figure 22B:
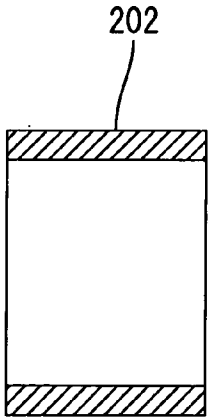
FIG. 22B is a sectional view of a spring in accordance with aspects of the present invention.
Figure 23A:
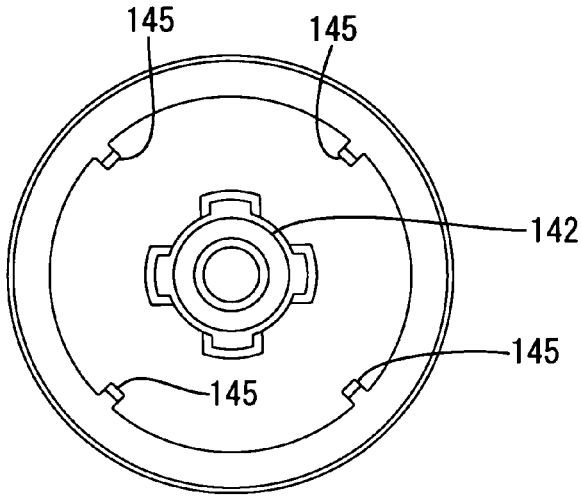
FIG. 23A is a front elevation of the flange member of FIG. 22A in accordance with aspects of the present invention.
Figure 23B:
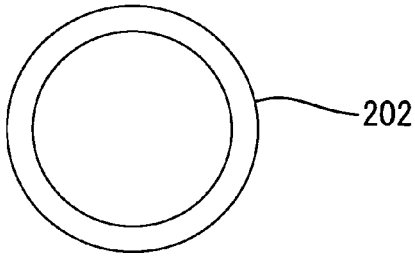
FIG. 23B is a front elevation of the spring of FIG. 22B in accordance with aspects of the present invention.
Figure 23C:
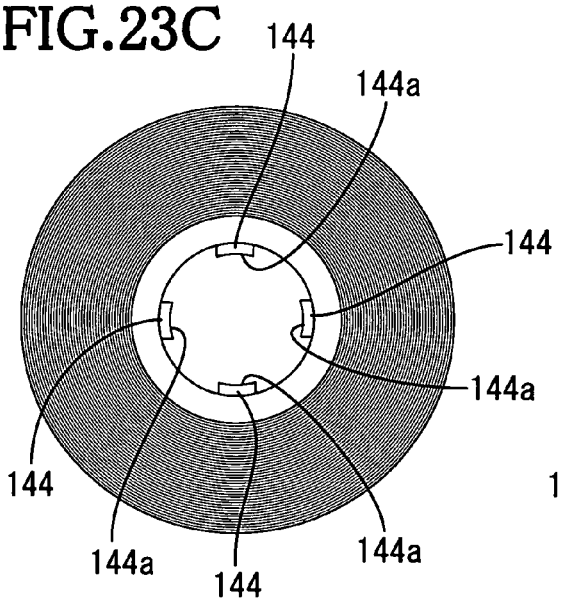
FIG. 23C is a front elevation of the spring receiving member of FIG. 22C in accordance with aspects of the present invention.

As shown in FIGS. 21, 23A, 23C, and 23D, the flange member 80 is formed with an engaging member 142, and the spring receiving member 91 is formed with engagement pawls 144 (functioning as an engaged portion) that are capable of being engaged with the engaging portion 142. The engaging portion 142 is provided to the flange member 80 so as to be adjacent to the outer surface 35*a* of the drum shaft 35 when the drum shaft 35 passes through the flange member 80. Each of the engagement pawls 144 has a protrusion 144*a* protruding toward the drum shaft 35 so as to engage corresponding portions of the engaging portion 142 around the engaging portion 142. With this structure, the engaging portion 142 of the flange member 80 and the engagement pawls 144 of the spring receiving member 91 are concentrated at a vicinity of the drum shaft 35. Therefore, as shown in FIGS. 22C and 23C, the engagement pawls 144 do not exist at the periphery of the spring receiving member 91.

Figure 22A:
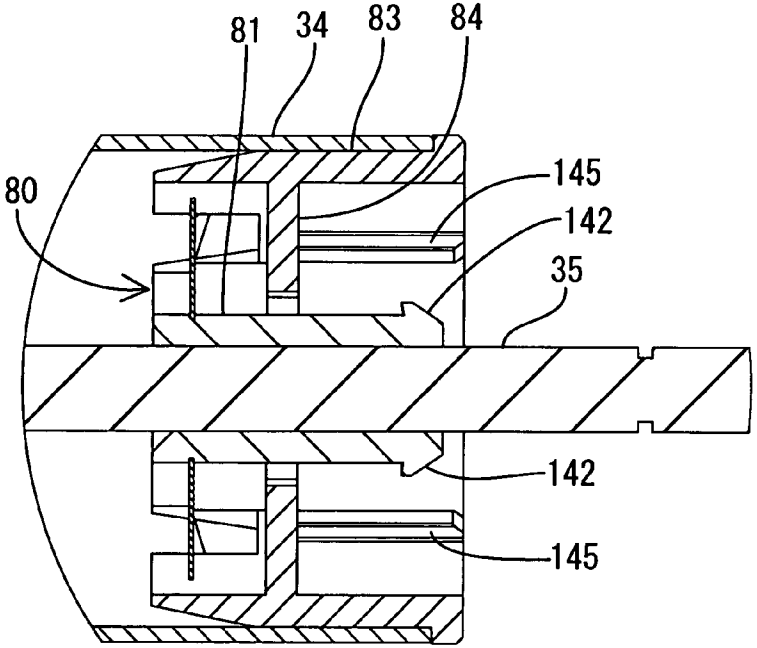
FIG. 22A is a sectional view of a flange member in accordance with aspects of the present invention.

As shown in FIGS. 22A and 23A, four ridges 145 are provided at an inner surface of the insertion portion 83 of the flange portion 80 so as to extend in a direction parallel to the axis direction of the drum shaft 35 at regular intervals. The spring receiving member 91 is provided with grooves 146 at a periphery of its flange portion 144*b* such that the grooves 146 are located at positions corresponding to the ridges 145. The grooves 146 also extend in a direction parallel to the axis direction of the drum shaft 35. The grooves 146 have a width which is slightly than that of the ridges 145.

When the flange member 80 and the spring receiving member 91 are assembled, the ridges 145 and the grooves 146 are aligned so that the ridges 145 are received by the corresponding grooves 146. Thus, when the flange member 80 and the spring member 91 are separated from and get closer to each other in the longitudinal direction of the drum body 34 by the action of the spring 202, the ridges 145 are guided by the grooves 146. In other words, the flange member 80 and the spring receiving member 91 are moved relative to each other in a direction parallel to the axis direction of the drum shaft 35, so that the flange member 80 and the spring member 91 do not become twisted.

Figure 23D:
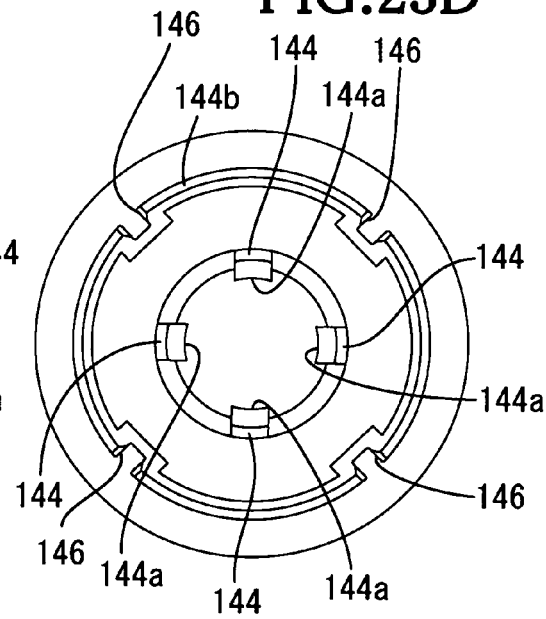
FIG. 23D is a rear elevation of the spring receiving member of FIG. 22C in accordance with aspects of the present invention.
Figure 24A:
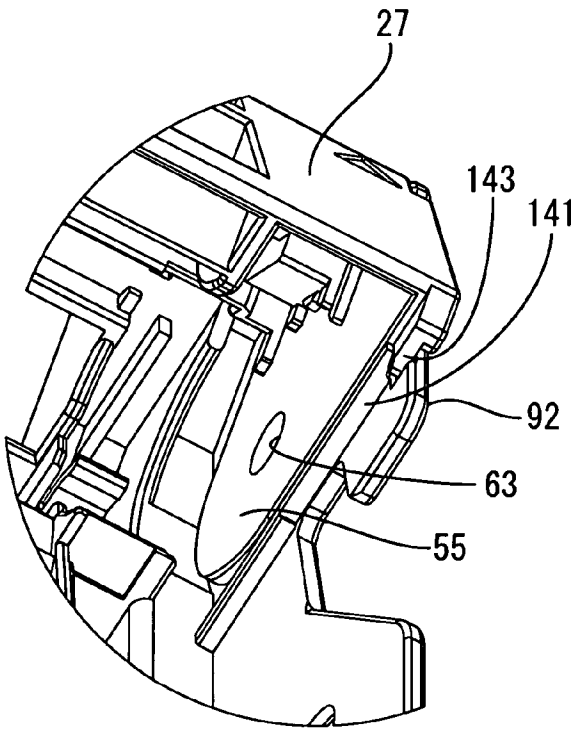
FIG. 24A is an enlarged view showing a vicinity of a right sidewall of the upper frame of FIG. 11 in accordance with aspects of the present invention.
Figure 24B:
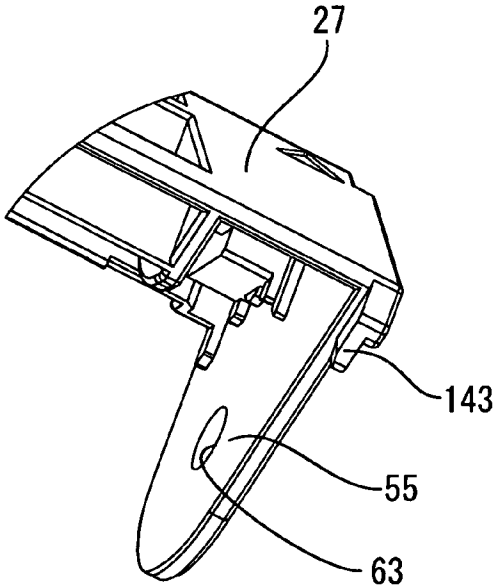
FIG. 24B illustrates the upper frame shown in FIG. 24A in accordance with aspects of the present invention.
Figure 24C:
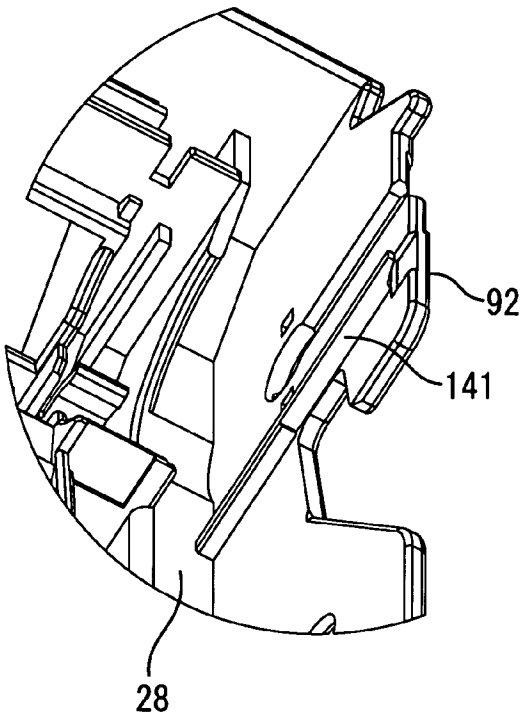
FIG. 24C illustrates the lower frame shown in FIG. 24A in accordance with aspects of the present invention.

Therefore, as shown in FIGS. 23C and 23D, there is no engagement pawls 144 at the periphery of the spring receiving member 91. A unit, in which the flange member 80 and the spring receiving member 91 are joined as described above, is supported by the right sidewall 55 via a pad 150, as shown in FIG. 21, and urges the drum body 34 toward the left lower side plate portion 57. As shown in FIGS. 21, 22C and 23C, a plurality of grooves are concentrically provided in the outer surface 91*a* of the spring receiving member 91. As shown in FIGS. 24A, 24B, and 24C, the right sidewall 55 supporting the spring receiving member 91 is supported by the lower frame 28, inside the sidewall 92 of the lower frame 28. The spring receiving member 91 is located further inside the right sidewall 55.

As shown in FIG. 8, the upper frame 27 to which the photosensitive member 29 is attached as described above, is then mounted to the lower frame 28 from above. At that time, first, the bearing members 66, 67 are brought into a state such that the flat side surfaces 74, 75 of the fixing portions 70 extend in parallel with the guiding direction (in an up-down direction) of the bearing member guiding portions 99 of the lower frame 28 (a state where the bearing members 66, 67 are turned 90 degrees from the state of FIG. 7C). Then, the bearing members 66, 67 are inserted into the respective shaft bearing member guiding portions 99 from above, so that their fixing portions 70 are moved toward the bearing member receiving portions 100 while being guided by the bearing member guiding portions 99. When the fixing portions 70 reach the bearing member receiving portions 100 and are received therein, the sidewalls 92 of the lower frame 28 are entered and caught in a gap between the flange portion 69 of the left bearing member 66 and the left sidewall 54 and a gap between the flange portion 69 of the bearing member 67 and the right sidewall 55 (FIG. 5), respectively. The inner surfaces (from which the shaft insertion portions 68 protrude) of the flange portions 69 of the bearing members 66, 67 are intimately in contact with the outer surfaces of the sidewalls 92 of the lower frame 28.

Immediately after the fixing portions 70 of the flange members 66, 67 are received by the bearing member receiving portions 100, the engaging protrusions 72 are received by the receiving recessed portions 103 formed in the sidewalls 92 of the lower frame 28. Then, a jig (not shown) is inserted into the jig hole 71 of the flange portion 69 of each of the bearing members 66, 67 to turn the bearing members 66, 67 approximately 90 degrees about the drum shaft 35 for separating the engaging protrusions 72 from the sidewalls 92 while the flange portions 69 are being warped. Then, the engaging protrusions 72 formed at the inner surfaces of the flange portions 69 face the engaging recessed portions 102 formed at the outer surfaces of the sidewalls 92. The flange portions 69 restore to a state so as to intimately contact the sidewalls 92 and the engaging protrusions 72 are engaged with and fitted into the recessed engaging recessed portions 102. Thus, the bearing members 66, 67 are held while their rotation is restricted by the lower frame 28. When the bearing members 66, 67 are turned approximately 90 degrees about the drum shaft 35, the fixing portions 70, in which the flat side surfaces 74, 75 are positioned so as to extend in parallel with the guiding direction, are also turned approximately 90 degrees in the bearing member receiving portions 100. Therefore, the flat side surfaces 74, 75 of the fixing portions 70 of the flange members 66, 67 are positioned so as to extend in the direction orthogonal to the guiding direction and the curved side surfaces 76, 77 of the fixing portions 70 extend in the direction parallel to the guiding direction. In this state, the fixing portions 70 are prevented from entering the bearing member guiding portions 99 and are fixed in the bearing member receiving portions 100. Thus, the bearing members 66, 67 are supported by the lower frame 28, and the upper frame 27 and the lower frame 28 are fixed to each other with being joined as described above.

If the upper frame 27 and the lower frame 28 are joined to each other as described above, the bearing members 66, 67 supported by the upper frame 27 are received and supported by the bearing member receiving portions 100 formed in the lower frame 28. By doing so, the upper frame 27 and the lower frame 28 are connected with each other and the relative position between the upper frame 27 and the lower frame 28 is determined via the bearing members 66, 67. In other words, the relative position between the upper frame 27 and the lower frame 28 is determined with respect to the drum shaft 35 of the photosensitive member 29 supported by the bearing members 66, 67. In the upper frame 27, the photosensitive member 29, the scorotron charger 30, and the cleaning brush 33 are supported. The relative position between the photosensitive member 29, the scorotron charger 30 and the cleaning brush 33 is determined with respect to the bearing members 66, 67 receiving the drum shaft 35 of the photosensitive member 29, without reference to the mounting of the lower frame 28. In the lower frame 28, the developing cartridge 31 and the transfer roller 32 are supported. In the state where the upper frame 27 is mounted to the lower frame 28, the position of the developing cartridge 31 and the transfer roller 32 relative to the upper frame 27 is determined with respect to the bearing members 66, 67 receiving the drum shaft 35 of the photosensitive member 29.

As a result, the relative position of the all the members, which are arranged around the photosensitive member 29 and act on the photosensitive member 29, namely, the scorotron charger 30, the developing cartridge 31, the transfer roller 32 and the cleaning brush 33, with respect to the photosensitive member 29, is determined with reference to the drum shaft 35 supported by the bearing members 66, 67.

As shown in FIG. 12A, a deformation preventing portion 141 is provided at the left sidewall 92 of the lower frame 28 in order to prevent the left sidewall 92 from being warped toward the outside in the longitudinal direction of the drum body 34 in the state where the upper frame 27 and the lower frame 28 are joined to each other as described above. The deformation preventing portion 141 is a rib that protrudes toward the inside in the longitudinal direction from the inner surface of the left sidewall 92 and is capable of engaging the left lower side plate portion 57. When the upper frame 27 and the lower frame 28 are joined to each other, an end portion of the deformation preventing portion 141 engages a protrusion 143 formed at the left lower side plate portion 57. This engagement can effectively prevent the left sidewall 92 from deforming toward the outside in the longitudinal direction of the photosensitive member 29. As shown in FIG. 24A, the right sidewall 92 is also provided with the deformation preventing portion 141 capable of engaging with a protrusion 143 of the right sidewall 55 in a similar manner.

While the invention has been described in detail with reference to the specific embodiment thereof, it would be apparent to those skilled in the art that various changes, arrangements and modifications may be applied therein without departing from the spirit and scope of the invention.

In the above-described illustrative embodiment, the opening of the first insertion hole 87*a* and the opening of the second insertion hole 60 completely overlap each other (the opening of the second insertion hole 60 completely includes the opening of the first insertion hole 87*a*). Alternatively, if the drum shaft 35 can be inserted into the first insertion hole 87*a* and the second insertion hole 60, the opening of the first insertion hole 87*a* and the opening of the second insertion hole 60 may partially overlap each other.

According to one aspect of the illustrative embodiment, a process cartridge includes a photosensitive drum, a gear that is attachable to an end of the photosensitive drum in a longitudinal direction of the photosensitive drum, a shaft member that is capable of being passing through an inside of the photosensitive drum and the gear so as to extend in the longitudinal direction of the photosensitive drum, and a frame that has a pair of shaft supporting portions which support both end portions of the shaft member at positions outside the photosensitive drum. One of the pair of shaft supporting portions functioning as a gear-side supporting portion which is provided on a side where the gear is disposed. The gear includes a first insertion hole, into which the shaft member is inserted, and a projecting portion, which protrudes outward from a side, which is opposite to a side facing the end of the photosensitive drum, of the gear. The gear-side supporting portion of the pair of shaft supporting portions includes a second insertion hole, into which the shaft member is inserted, and a positioning member, which is used to position the projecting portion at a predetermined position and inwardly protrudes from a surface, which faces the photosensitive drum, of the gear-side supporting portion in the longitudinal direction of the photosensitive drum. The positioning member is arranged such that an opening of the first insertion hole and an opening of the second insertion hole overlap each other within a range in which the shaft member can be inserted thereto while the projecting portion is positioned at the predetermined position.

With this structure, the projecting portion is positioned by the positioning member provided at the frame, so that the first insertion hole provided on the gear side and the second insertion hole provided on the frame side are maintained at an appropriate position where the shaft member can be inserted thereto. Thus, the process cartridge has a structure that is easily assembled.

According to another aspect of the illustrative embodiment, in the process cartridge, the positioning member may be arranged so as to allow the projecting portion positioned at the predetermined position to move relative to the positioning member in a specific insertion/removal direction and to prevent the projecting portion from moving relative to the positioning member in directions other than the specific insertion/removal direction.

With this arrangement, the projecting portion is prevented from moving relative to the positioning member in the directions other than the specific insertion/removal direction, so that the projecting portion is stably maintained at the position by the positioning member. Thus, the first insertion hole provided on the gear side and the second insertion hole provided on the frame side are prevented from being displaced from each other, so that the process cartridge has a structure in which the shaft member can be further easily inserted into the first and second insertion holes.

According to another aspect of the illustrative embodiment, in the process cartridge, the positioning member may include a guiding portion that guides the projecting portion to the predetermined position.

With this structure, the projecting portion is smoothly guided to the predetermined position by the guiding portion when the photosensitive drum is mounted to the frame. Thus, the joining of the photosensitive drum to the frame is further facilitated.

According to another aspect of the illustrative embodiment, in the process cartridge, the opening of the second insertion hole may be larger in size than the opening of the first insertion hole.

With this structure, the opening of the first insertion hole and the opening of the second insertion hole can be further easily overlap each other within the range where the shaft member can be inserted thereto, so that the insertion of the shaft member can be further easily performed. In addition, the size of the opening of the second insertion hole is larger than that of the first insertion hole while the size of the opening of the first insertion hole which is difficult to have a large hole therein is minimized. Thus, the opening of the first insertion hole and the opening of the second insertion hole can be further easily overlap each other within the range where the shaft member can be inserted thereto, so that the insertion of the shaft member can be further easily performed.

According to another aspect of the illustrative embodiment, the process cartridge may further include a bearing member that is provided in the second insertion hole to rotatably support the shaft member.

With this structure, while the size of the opening of the second insertion hole is made large, the rotation of the shaft member can be made stable.

According to another aspect of the illustrative embodiment, in the process cartridge, a protruding amount of the projecting portion may be greater than a protruding amount of the positioning member in the longitudinal direction of the photosensitive drum.

With this structure, a side surface of the gear does not contact the positioning member, so that the rotation accuracy of the gear is increased and a noise traceable to the contact of the gear and the positioning member (e.g. a noise to be caused by rubbing between the side surface of the gear and the positioning member) is hardly caused.

According to another aspect of the illustrative embodiment, the process cartridge may further include a first flange portion that is attachable to another end portion of the photosensitive drum in the longitudinal direction, a second flange portion that is provided outside the first flange portion in the longitudinal direction and is capable of engaging the first flange portion, and an urging member that is disposed between the first flange portion and the second flange portion and urges the first and second flange portions to make them separate from each other in the longitudinal direction. The second flange portion is capable of relatively moving in a direction to close to the first flange portion against an urging force of the urging member. The second flange portion is supported at its outer surface by another of the pair of the shaft supporting portion which is opposite to the gear-side supporting portion, so that the photosensitive drum, to which the first flange portion is attached, is urged in a direction to close to the gear-side supporting portion.

With this structure, the photosensitive drum is urged in the direction to close to the gear-side supporting portion all the time, so that the photosensitive drum does not significantly slide in its longitudinal direction and the photosensitive drum can be stably rotated. In addition, the second flange portion is capable of engaging the first flange portion which is to be attached to the photosensitive drum. Thus, the second flange portion and the first flange portion can be handled with being joined to each other even when the photosensitive drum is not mounted to the frame, so that the parts control can be easily performed.

According to another aspect of the illustrative embodiment, in the process cartridge, the first flange portion may include an engaging portion, and the second flange portion may include an engaged portion that is capable of engaging the engaging portion. Further, one of the engaging portion and the engaged portion may be provided adjacent to an outer surface of the shaft member and another of the engaging portion and the engaged portion is provided so as to engage the one of the engaging portion and the engaged portion.

With this structure, the engaging portion and the engaged portion can be concentratedly provided at the vicinity of the shaft member. The engaged portion of the second flange portion is provided adjacent to the shaft member, so that the engaged portion does not exist at a periphery of the second flange portion. Thus, the periphery of the second flange portion can be used for connection with a part other than the first flange portion, so that the parts connection can be achieved by effectively using space.

According to another aspect of the illustrative embodiment, in the process cartridge, the photosensitive drum may have a hollow body and an inner surface that is made of a conductive material, and the outer surface of the shaft member is made of a conductive material. In addition, the process cartridge may further include a metal member that has a plate shape and electrically connects the inner surface of the photosensitive drum and the outer surface of the shaft member. The metal member may include a contact portion that is elastically deformable and is capable of elastically return to a position so as to contact the shaft member by a predetermined contact force. The contact portion may have an opening that penetrates through the contact portion in its thickness direction.

With this structure, the shaft member and the photosensitive drum can be electrically connected with each other and an elastic force of the contact portion is restricted by the provision of the opening therein, so that the contact portion of the metal member and the shaft member can be contacted with each other by an appropriate force. Therefore, a rubbing sound and a rubbing of the contact portion traceable to the contact of the shaft member and the contact portion of the metal member can be prevented. In addition, the elastic force is restricted by forming the opening in the contact portion, so that the contact portion is resistant to friction as compared with a contact portion having a structure in which the elastic force is restricted by thinning the metal member.

According to another aspect of the illustrative embodiment, in the process cartridge, the contact portion may contact the outer surface of the shaft member, and the opening may be formed in the contact portion such that an edge of the opening is not located at a position where the contact portion and the shaft member are contacted with each other.

With this structure, the edge of the opening is not located at the contact position, so that the contact portion and the outer surface of the shaft member are surely contacted with each other. Thus, the contact portion and the shaft member can be stably contacted with each other.

According to another aspect of the illustrative embodiment, in the process cartridge, the frame may include a first frame portion that has the pair of shaft supporting portions, and a second frame portion that is capable of connecting with the first frame portion and has a pair of wall portions that supports the pair of corresponding shaft supporting portions from outside in the longitudinal direction. Each of the wall portions may include a deformation preventing portion capable of engaging the corresponding one of the pair of the shaft supporting portions in order to prevent the wall portions from being warped toward the outside in the longitudinal direction.

With this structure, the photosensitive drum can be protected by the two frame portions, and the wall portions of the second frame portion disposed outside the first frame portion are prevented from being warped toward the outside in the longitudinal direction. Accordingly, degradation and damage to the wall portions can be effectively prevented.

According to another aspect of the illustrative embodiment, an image forming apparatus may perform image formation by using the process cartridge employing one or more aspects of the illustrative embodiments.

By doing so, the same effects as those described above can be obtained, and the image forming apparatus having a structure that can be easily manufactured can be obtained.

What is claimed is:

1. A process cartridge comprising:

a photosensitive drum;

a gear that is attachable to an end of the photosensitive drum in a longitudinal direction of the photosensitive drum;

a shaft member that is capable of passing through an inside of the photosensitive drum and the gear so as to extend in the longitudinal direction of the photosensitive drum; and a frame that has a pair of shaft supporting portions which supports both end portions of the shaft member at positions outside the photosensitive drum, one of the pair of shaft supporting portions functioning as a gear-side supporting portion which is provided on a side where the gear is disposed, wherein the gear includes a first insertion hole, into which the shaft member is inserted, and a projecting portion, which protrudes outward from a side, which is opposite to a side facing the end of the photosensitive drum, of the gear;

wherein the gear-side supporting portion of the pair of shaft supporting portions includes a second insertion hole, into which the shaft member is inserted, and a positioning member, which is used to position the projecting portion at a predetermined position and inwardly protrudes from a surface, which faces the photosensitive drum, of the gear-side supporting portion in the longitudinal direction of the photosensitive drum; and the positioning member is arranged such that an opening of the first insertion hole and an opening of the second insertion hole overlap each other within a range in which the shaft member can be inserted thereto while the projecting portion is positioned at the predetermined position.

2. The process cartridge according to claim 1, wherein the positioning member is arranged so as to allow the projecting portion positioned at the predetermined position to move relative to the positioning member in a specific insertion/removal direction and to prevent the projecting portion from moving relative to the positioning member in directions other than the specific insertion/removal direction.

3. The process cartridge according to claim 1, wherein the positioning member includes a guiding portion that guides the projecting portion to the predetermined position.

4. The process cartridge according to claim 1, wherein the opening of the second insertion hole is larger in size than the opening of the first insertion hole.

5. The process cartridge according to claim 1, further comprising a bearing member that is provided in the second insertion hole to rotatably support the shaft member.

6. The process cartridge according to claim 1, wherein a protruding amount of the projecting portion is greater than a protruding amount of the positioning member in the longitudinal direction of the photosensitive drum.

7. The process cartridge according to claim 1, further comprising:

a first flange portion that is attachable to another end portion of the photosensitive drum in the longitudinal direction;

a second flange portion that is provided outside the first flange portion in the longitudinal direction and is capable of engaging the first flange portion; and an urging member that is disposed between the first flange portion and the second flange portion and urges the first and second flange portions to make them separate from each other in the longitudinal direction, wherein:

the second flange portion is capable of relatively moving in a direction to close to the first flange portion against an urging force of the urging member; and the second flange portion is supported at its outer surface by another of the pair of the shaft supporting portion which is opposite to the gear-side supporting portion, so that the photosensitive drum, to which the first flange portion is attached, is urged in a direction to close to the gear-side supporting portion.

8. The process cartridge according to claim 7, wherein the first flange portion includes an engaging portion; and wherein the second flange portion includes an engaged portion that is capable of engaging the engaging portion, wherein one of the engaging portion and the engaged portion is provided adjacent to an outer surface of the shaft member and another of the engaging portion and the engaged portion is provided so as to engage the one of the engaging portion and the engaged portion.

9. The process cartridge according to claim 1, wherein the photosensitive drum has a hollow body and an inner surface that is made of a conductive material;

wherein the outer surface of the shaft member is made of a conductive material; and wherein the process cartridge further comprising a metal member that has a plate shape and electrically connects the inner surface of the photosensitive drum and the outer surface of the shaft member, the metal member including a contact portion that is elastically deformable and is capable of elastically return to a position so as to contact the shaft member by a predetermined contact force, the contact portion having an opening that penetrates through the contact portion in its thickness direction.

10. The process cartridge according to claim 9, wherein the contact portion contacts the outer surface of the shaft member; and wherein the opening is formed in the contact portion such that an edge of the opening is not located at a position where the contact portion and the shaft member are contacted with each other.

11. The process cartridge according to claim 1, wherein the frame includes:

a first frame portion that has the pair of shaft supporting portions; and a second frame portion that is capable of connecting with the first frame portion and has a pair of wall portions that supports the pair of corresponding shaft supporting portions from outside in the longitudinal direction, wherein each of the wall portions includes a deformation preventing portion capable of engaging the corresponding one of the pair of the shaft supporting portions in order to prevent the wall portions from being warped toward the outside in the longitudinal direction.

12. An image forming apparatus that performs image formation by using the process cartridge of claim 1.

13. A process cartridge comprising:

a photosensitive drum;

a gear that is attachable to an end of the photosensitive drum in a longitudinal direction of the photosensitive drum;

a shaft member that is capable of passing through an inside of the photosensitive drum and the gear so as to extend in the longitudinal direction of the photosensitive drum; and a frame that has a pair of shaft supporting portions which supports both end portions of the shaft member at positions outside the photosensitive drum, one of the pair of shaft supporting portions functioning as a gear-side supporting portion which is provided on a side where the gear is disposed, wherein the gear includes a first insertion hole, into which the shaft member is inserted, and a projecting portion, which protrudes outward from a side, which is opposite to a side facing the end of the photosensitive drum, of the gear;

wherein the gear-side supporting portion of the pair of shaft supporting portions includes a second insertion hole, into which the shaft member is inserted, and a positioning member, which is used to position the projecting portion at a predetermined position and inwardly protrudes from a surface, which faces the photosensitive drum, of the gear-side supporting portion in the longitudinal direction of the photosensitive drum.

14. The process cartridge according to claim 13, wherein the positioning member is arranged such that an opening of the first insertion hole and an opening of the second insertion hole overlap each other within a range in which the shaft member can be inserted thereto while the projecting portion is positioned at the predetermined position.

* * * * *